US012584190B2

(12) United States Patent
Stoy et al.

(10) Patent No.: US 12,584,190 B2
(45) Date of Patent: Mar. 24, 2026

(54) METHODS FOR SELECTIVE RECOVERY OF RARE EARTH ELEMENTS AND METALS FROM COAL ASH BY IONIC LIQUIDS

(71) Applicant: Georgia Tech Research Corporation, Atlanta, GA (US)

(72) Inventors: Laura Stoy, Atlanta, GA (US); Ching-Hua Huang, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 874 days.

(21) Appl. No.: 17/786,929

(22) PCT Filed: Dec. 18, 2020

(86) PCT No.: PCT/US2020/066100
§ 371 (c)(1),
(2) Date: Jun. 17, 2022

(87) PCT Pub. No.: WO2021/127497
PCT Pub. Date: Jun. 4, 2021

(65) Prior Publication Data

US 2023/0357886 A1 Nov. 9, 2023

Related U.S. Application Data

(60) Provisional application No. 62/950,678, filed on Dec. 19, 2019.

(51) Int. Cl.
*C22B 7/00* (2006.01)
*C22B 1/00* (2006.01)
(Continued)

(52) U.S. Cl.
CPC ..... *C22B 7/007* (2013.01); *C22B 1/005* (2013.01); *C22B 7/02* (2013.01); *C22B 59/00* (2013.01)

(58) Field of Classification Search
None
See application file for complete search history.

(56) References Cited

U.S. PATENT DOCUMENTS 8,658,114 B2 2/2014 Nebeker et al.
9,637,832 B2 5/2017 Sutto
(Continued)

FOREIGN PATENT DOCUMENTS

WO 2007147222 A2 12/2007
WO 2015106324 A1 7/2015
WO WO-2017096470 A1 * 6/2017 ..... C22B 58/00

OTHER PUBLICATIONS

Nockemann, P., et al. Speciation of rare-earth metal complexes in ionic liquids: A multiple-technique approach. Chem. Eur. J. 2009, 15, 1449-1461. (Year: 2009).*
(Continued)

*Primary Examiner* — Anthony J Zimmer
*Assistant Examiner* — Zachary John Baum
(74) *Attorney, Agent, or Firm* — Mintz Levin Cohn Ferris Glovsky and Popeo, P.C.

(57) ABSTRACT

An exemplary embodiment of the present disclosure provides a method to extract components from a metal-containing material, forming a first multicomponent system comprising an ionic liquid and a first aqueous component, wherein the first aqueous component and the ionic liquid form an immiscible mixture when the first multicomponent system is at a temperature below a critical temperature, contacting a metal-containing material with the first multi-component system, adjusting the temperature of the first multi-component system above the first critical temperature to form a miscible mixture with the ionic liquid and the first aqueous component, reverting the temperature of the first multicomponent system below the critical temperature to form an immiscible mixture with the ionic liquid and the first
(Continued)

aqueous component, and isolating the ionic liquid from the first aqueous component and the metal-containing material, wherein the ionic liquid comprises one or more metals from the metal-containing material.

30 Claims, 19 Drawing Sheets

(51) Int. Cl.
*C22B 7/02* (2006.01)
*C22B 59/00* (2006.01)

(56) References Cited

U.S. PATENT DOCUMENTS

2005/0269001 A1 12/2005 Liotta et al.
2016/0222532 A1 8/2016 Sutto

OTHER PUBLICATIONS

Depuydt, D., et al. Overview of the effect of salts on biphasic ionic liquid/water solvent extraction systems: Anion exchange, mutual solubility, and thermomorphic properties. J. Phys. Chem. B 2015, 119, 6747-6757. (Year: 2015).*
International Search Report and Written Opinion from Application No. PCT/US2020/066100 dated Apr. 7, 2021.
DuPont, et al., "Recycling of Rare Earths from NdFeB Magnets Using a Combined Leaching/Extraction System Based on the Acidity and Thermomorphism of the Ionic Liquid [Hbet] [Tf2n]," Green Chemistry vol. 17 Mar. 2, 2015.
Kishor, et al, "Quternary Ammonium-Based Task-specific Ionic Liquid: An Efficient and 'Green' Separation for 'f block' Elements," Separation Science and Technology, 2017.
Yagmurlu, et al, "Effect of Aqueous Media on the Recovery of Scandium by Selective Precipitation," Metals vol. 8, No. 314, May 13, 2018—pp. 1-13.
Search Report from European Patent Application No. 20901414.1 dated Nov. 24, 2023.
Onghena Bieke, et al., "Recovery of Scandium From Sulfaction-Roasted Leachates of Bauxite Residue by Solvent Extraction with the Ionic Liquid Betainium bix(trifluoromethylsulfonly)imide," Dec. 11, 2016 Separation and Purification Technology, Elsevier Science vol. 176.
Dupont et al. (2015) "Rare-earth Recycling using a Functionalized Ionic Liquid for the Selective Dissolution and Revalorization of $Y_2O_3$:$Eu^{3+}$ from Lamp Phosphor Waste", Green Chem, 17(2):856-868.
Hoogerstraete et al. (2014) "Determination of Halide Impurities in Ionic Liquids by Total Reflection X-ray Fluorescence Spectrometry", Anal Chem, 86(8):3931-3938.
Hoogerstraete et al. (2013) "Homogeneous Liquid-Liquid Extraction of Metal Ions with a Functionalized Ionic Liquid", The Journal of Physical Chemistry Letters, 4(10):1659-1663.
Hoogerstraete et al. (2013) "Homogeneous Liquid-Liquid Extraction of Rare Earths with the Betaine-Betainium Bis(trifluoromethylsulfonyl)imide Ionic Liquid System", Int. J. Mol. Sci., 14(11):21353-21377.
King et al. (Jul. 1, 2018) "Aqueous Acid and Alkaline Extraction of Rare Earth Elements from Coal Combustion Ash", International Journal of Coal Geology, 195:75-83.
McCarthy et al. (1990) "Use of a Database of Chemical, Mineralogical and Physical Properties of North American Fly Ash to Study the Nature of Fly Ash and its Utilization as a Mineral Admixture in Concrete", Materials Research Society, 178:3-33.
Taggart et al. (2018) "Effects of Roasting Additives and Leaching Parameters on the Extraction of Rare Earth Elements from Coal Fly Ash", International Journal of Coal Geology, 196:106-114.
Wirth et al. (2019) "Evaluation of Alternative Fly Ashes as Supplementary Cementitious Materials", ACI Materials Journal, 116(4):69-77.
Wirth et al. (2019) "Mineral Phases and Carbon Content in Weathered Fly Ashes", Fuel, 236:1567-1576.

* cited by examiner

METHODS FOR SELECTIVE RECOVERY OF RARE EARTH ELEMENTS AND METALS FROM COAL ASH BY IONIC LIQUIDS

CROSS-REFERENCE TO RELATED APPLICATIONS

This application is a national stage application filed under 35 U.S.C. § 371, of International Patent Application No. PCT/US2020/066100, filed Dec. 18, 2020, which claims the benefit and priority under 37 U.S.C. 119(e) of U.S. Provisional Application Ser. No. 62/950,678, filed on Dec. 19, 2019, the entire contents of which are incorporated herein by reference i their entirety as if fully set forth below.

STATEMENT REGARDING FEDERALLY SPONSORED RESEARCH

This invention was made with government support under the DGE-1650044 award awarded by the National Science Foundation. The government has certain rights in the invention.

FIELD OF THE DISCLOSURE

The various embodiments of the present disclosure relate generally to methods for selectively recovering metals and rare earth metals from coal by-products, and more particularly to methods of recovering metals and rare earth metals from fly ash and coal ash by ionic liquids.

BACKGROUND

Rare earth elements (REEs) play invaluable roles in a variety of technologies ranging from consumer products to defense applications. These technologies depend heavily on REEs' unique chemical properties, and to date, no adequate replacements for these high-performing elements have been developed. As such, exploration of REE-rich wastes, such as bauxite residue, wastewater, slag and mine tailings, has been prioritized. Some recent investigation on REE-poor waste products, such as coal fly ash, suggest that recovery of REEs from these REE-poor waste products is a sustainable, scalable, and selective method; however, existing methods to date require highly corrosive solutions, such as HF and concentrated $H_2O_2$, among others, that are hazardous, energy intensive, multi-stage, and complex in order to process the durable aluminosilicates founds in REE-poor waste products. Further, when using highly corrosive solutions, the REE's within the waste product are digested along with the bulk elements of the waste product, resulting in an impure mixture of REEs and bulk elements, requiring further separation processes.

What is needed, therefore, are methods for efficiently and selectively extracting REE's while leaving bulk elements behind, using safer materials and energy-efficient techniques. Embodiments of the present disclosure address this need as well as other needs that will become apparent upon reading the description below in conjunction with the drawings.

BRIEF SUMMARY

The present disclosure relates to methods for extracting components from metal-containing materials. An exemplary embodiment of the present disclosure can comprise providing a metal-containing material and contacting the metal-containing material with an alkaline component. The method can additionally comprise forming a first multicomponent system having an ionic liquid and a first aqueous component. The first aqueous component and the ionic liquid can form an immiscible mixture when the first multicomponent system is at a temperature below a first critical temperature and/or at a pH above a critical pH value. The method can further comprise contacting the metal-containing material with the first multicomponent system, adjusting the temperature and/or the pH of the first multicomponent system. Adjusting the temperature of the first multicomponent system above the first critical temperature and/or the pH of the first multicomponent system above the critical pH value can form a miscible mixture with the ionic liquid and the first aqueous component. The method can further comprise reverting the temperature and/or the pH of the first multicomponent system. Reverting the temperature of the first multicomponent system below the first critical temperature and/or pH of the first multicomponent system below the critical pH value can form an immiscible mixture with the ionic liquid and the first aqueous component. The method can also comprise isolating the ionic liquid from the first aqueous component and the metal-containing material. The isolated ionic liquid can have one or more metals from the metal-containing material.

In any of the embodiments disclosed herein, the method can further comprise, prior to reverting the temperature of the first multicomponent system below the first critical temperature and/or the pH of the first multicomponent system below the critical pH value, extracting one or more metals from the metal-containing material into the miscible mixture.

In some embodiments, the method can further comprise, after reverting the temperature of the first multicomponent system below the first critical temperature and/or the pH of the first multicomponent system below the critical pH value, dissolving the one or more metals from the metal-containing material into the ionic liquid.

In some embodiments, the method can further comprise, prior to adjusting the temperature of the first multicomponent system above the first critical temperature and/or the pH of the first multicomponent system above the critical pH value, adding one or more salts to the first multicomponent system to create a salt concentration of the first multicomponent system above a critical salt concentration to form a miscible mixture with the ionic liquid and the first aqueous component.

In any of the embodiments disclosed herein, the method can further comprise forming a second multicomponent system. The second multicomponent system can comprise the isolated ionic liquid having one or more metals from the metal-containing material and an acidic component. The acidic component and the ionic liquid can form an immiscible mixture when the second multicomponent system is at a temperature below a second critical temperature. The method can additionally comprise adjusting the temperature of the second multicomponent system. Adjusting the temperature of the second multicomponent system above the second critical temperature can form a miscible mixture with the ionic liquid and the acidic component. The method can further comprise reverting the temperature of the second multicomponent system. Reverting the temperature of the second multicomponent system below the second critical temperature can form an immiscible mixture with the ionic liquid and the acidic component. The method can also comprise isolating the one or more metals from the second multicomponent system.

In some embodiments, the method can further comprise, after reverting the temperature of the second multicomponent system below the second critical temperature, extracting the one or more metals from the ionic liquid into the acidic component.

In some embodiments, the method can additionally comprise, after isolating the one or more metals from the second multicomponent system, isolating the ionic liquid from the second multicomponent system and contacting the isolated ionic liquid with a second aqueous component.

In any of the embodiments disclosed herein, the second aqueous component can replenish the ionic liquid.

In some embodiments, the method can further comprise isolating the ionic liquid from the second aqueous component and reusing the ionic liquid.

In some embodiments, the metal-containing material can comprise a combustion by-product.

In some embodiments, the combustion by-product can be selected from coal ash, fly ash, bottom ash, incineration ash, unrefined mineral ores, metal oxides, clays, particulate matter, soot, black carbon and combinations thereof.

In any of the embodiments disclosed herein, the metal-containing material can have a concentration of one or more metal from about 0.001 ppm to about 100,000 ppm.

In some embodiments, the metal-containing material can have a concentration of one or more metal from about 0.001 ppm to about 1,000 ppm.

In some embodiments, the metal-containing material can comprise one or more metals selected from the group consisting of Al, Ba, Fe, Ti, As, Cd, Co, Cu, Hg, Mn, Ni, Pb, Rb, Sb, Sr, V, U, Ce, Dy, Er, Eu, Gd, Ho, La, Lu, Nd, Pr, Pm, Sm, Sc, Se, Tb, Th, Tm, Yb, and Y.

In some embodiments, the alkaline component can comprise an aqueous solution.

In any of the embodiments disclosed herein, the alkaline component can be selected from NaOH, KOH, LiOH, $Ca(OH)_2$, CaO, $Mg(OH)_2$, $NH_4OH$, $NH_3$, and combinations thereof.

In some embodiments, the concentration of the alkaline component can be from about 0.1 M to about 10 M.

In some embodiments, the alkaline component can comprise a second component.

In any of the embodiments disclosed herein, the second component can comprise a reductant selected from the group consisting of ascorbic acid, hydroxylamine, hydroquinone, sodium dithionite, sodium dithionate, potassium dithionate, barium dithionate, sulfur dioxide, sodium sulfite, hydrogen sulfide, sodium thiosulfate, hydrazine, iodide, and sodium borohydride.

In any of the embodiments disclosed herein, the ionic liquid can comprise one or more of the following structures:

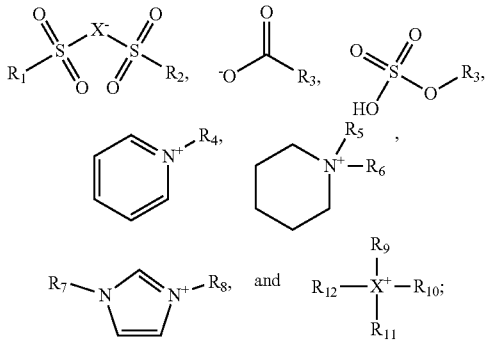

wherein:

X is N or P;

$R_1$ and $R_2$ are each independently selected from H, OH, or $CF_3$;

$R_3$ is:

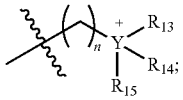

$R_4$-$R_8$ are each independently selected from H, substituted or unsubstituted $C_{1-8}$ alkyl;

$R_9$-$R_{12}$ are each independently selected from substituted or unsubstituted $C_{1-10}$ alkyl or $(C_{1-10})$—OH;

Y is N or P;

n is an integer ranging from 1 to 8; and $R_{13}$, $R_{14}$, and $R_{15}$ are each independently selected from H, substituted or unsubstituted $C_{1-8}$ alkyl.

In some embodiments, the ionic liquid can comprise at least one cation and at least one anion.

In some embodiments, the cation can comprise a carboxylic acid.

In some embodiments, the cation can comprise a sulfuric acid.

In some embodiments, the cation can comprise an alkylsulfuric acid.

In some embodiments, the cation can comprise a choline.

In some embodiments, the anion can comprise a bis (trifluoromethylsulfonyl)imide.

In some embodiments, the anion can comprise a hexafluorophosphate.

In some embodiments, the anion can comprise a tetrafluoroborate.

In some embodiments, the anion can comprise a nitrate.

In some embodiments, the anion can comprise a triflate.

In some embodiments, the anion can comprise a mesylate.

In some embodiments, the anion can comprise a chloride.

In any of the embodiments disclosed herein, the ionic liquid can comprise [H(bet)][Tf2N].

In some embodiments, the ionic liquid can comprise a room-temperature ionic liquid.

In some embodiments, the first aqueous component can comprise a salt.

In any of the embodiments disclosed herein, the salt can comprise a nitrate salt selected from the group consisting of $NaNO_3$, $KNO_3$, $LiNO_3$, $NH_3NO_3$, $Be(NO_3)_2$, $Mg(NO_3)_2$, $Ca(NO_3)_2$, $Sr(NO_3)_2$, $Ba(NO_3)_2$, $Zn(NO_3)_2$, $Ni(NO_3)_2$, $Fe(NO_3)_2$, $Cu(NO_3)_2$, $Al(NO_3)_3$, $Fe(NO_3)_3$, $Pb(NO_3)_2$, $AgNO_3$, $AuNO_3$, and combinations thereof.

In some embodiments, the salt can comprise a halide salt selected from the group consisting of LiF, NaF, KF, $NH_4F$, $BeF_2$, $MgF_2$, $SrF_2$, $BaF_2$, $ZnF_2$, $NiF_2$, $FeF_2$, $CuF_2$, $AlF_3$, $FeF_3$, $PbF_2$, AgF, AuF, LiCl, NaCl, KCl, $NH_4Cl$, $BeCl_2$, $MgCl_2$, $SrCl_2$, $BaCl_2$, $ZnCl_2$, $NiCl_2$, $FeCl_2$, $CuCl_2$, $AlCl_3$, $FeCl_3$, $PbCl_2$, AuCl, LiBr, NaBr, KBr, $NH_4Br$, $BeBr_2$, $MgBr_2$, $SrBr_2$, $BaBr_2$, $ZnBr_2$, $NiBr_2$, $FeBr_2$, $CuBr_2$, $AlBr_3$, $FeBr_3$, $PbBr_2$, AuBr, LiI, NaI, KI, $NH_4I$, $MgI_2$, $SrI_2$, $BaI_2$, $ZnI_2$, $NiI_2$, $FeI_2$, $AlI_3$, $PbI_2$, and combinations thereof.

In some embodiments, the salt can comprise a carbonate salt selected from the group consisting of $Li_2CO_3$, $Na_2CO_3$, $K_2CO_3$, $(NH_4)_2CO_3$, $BaCO_3$, and combinations thereof.

In some embodiments, the salt can comprise a chlorate salt selected from the group consisting of $NaClO_3$, $KClO_3$, $LiClO_3$, $NH_4ClO_3$, $Mg(ClO_3)_2$, $Ca(ClO_3)_2$, $Sr(ClO_3)_2$, $Ba(ClO_3)_2$, $Zn(ClO_3)_2$, $Ni(ClO_3)_2$, $Fe(ClO_3)_2$, $Cu(ClO_3)_2$, $Al(ClO_3)_3$, $Fe(ClO_3)_3$, $Pb(ClO_3)_2$, $AgClO_3$, $AuClO_3$, and combinations thereof.

In some embodiments, the salt can comprise a perchlorate salt selected from the group consisting of $NaClO_4$, $KClO_4$, $NH_4ClO_4$, and combinations thereof.

In any of the embodiments disclosed herein, the first aqueous component can comprise a pH value from about 2.5 to about 5.5.

In some embodiments, the first multicomponent system can comprise a first critical temperature from about 30° C. to about 70° C.

In some embodiments, the first multicomponent system can comprise a critical pH value from about 2 to about 8.

In some embodiments, isolating the ionic liquid can comprise filtering, decanting, centrifuging, distilling evaporating, and combinations thereof.

In some embodiments, the second multicomponent system can comprise a second critical temperature from about 30° C. to about 70° C.

In any of the embodiments disclosed herein, the first critical temperature can comprise the same critical temperature as the second critical temperature.

In some embodiments, the first critical temperature can comprise a different critical temperature than the second critical temperature.

In some embodiments, the acidic component can comprise an aqueous solution.

In any of the embodiments disclosed herein, the acidic component can be selected from HCl, $HTf_2N$, $HNO_3$, $H_3PO_4$, $H_2SO_4$, $H_3BO_3$, HF, HBr, $HClO_4$, HI, and combinations thereof.

In some embodiments, the acidic component can comprise a solid.

In some embodiments, the acidic component can be selected from the group consisting of oxalic acid, citric acid, tartaric acid, maleic acid, formic acid, acetic acid, trichloroacetic acid, hydrocyanic acid, and combinations thereof.

In any of the embodiments disclosed herein, the acidic component can comprise a pH value from about −1 to about 6.5.

In some embodiments, isolating the one or more metals from the second multicomponent system can comprise one or more of filtering, decanting, centrifuging, distilling, precipitating, calcinating, evaporating, and applying an electrical potential.

In some embodiments, the second aqueous component can comprise water.

In some embodiments, the second aqueous component can comprise one or more salts.

In some embodiments, the second aqueous component can comprise an acidic solution.

In some embodiments, the second aqueous component can comprise an alkaline solution.

In some embodiments, isolating the ionic liquid from the second aqueous component can comprise one or more of decanting, centrifuging, distilling, and evaporating.

These and other aspects of the present disclosure are described in the Detailed Description below and the accompanying drawings. Other aspects and features of embodiments will become apparent to those of ordinary skill in the art upon reviewing the following description of specific, exemplary embodiments in concert with the drawings. While features of the present disclosure may be discussed relative to some embodiments and figures, all embodiments of the present disclosure can include one or more of the features discussed herein. Further, while one or more embodiments may be discussed as having some advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

FIG. 10A shows untreated metal-containing materials; FIG. 10B shows pretreated metal-containing materials; and FIG. 10C shows metal-containing material post ionic liquid leaching.

DETAILED DESCRIPTION

Figure 1A:
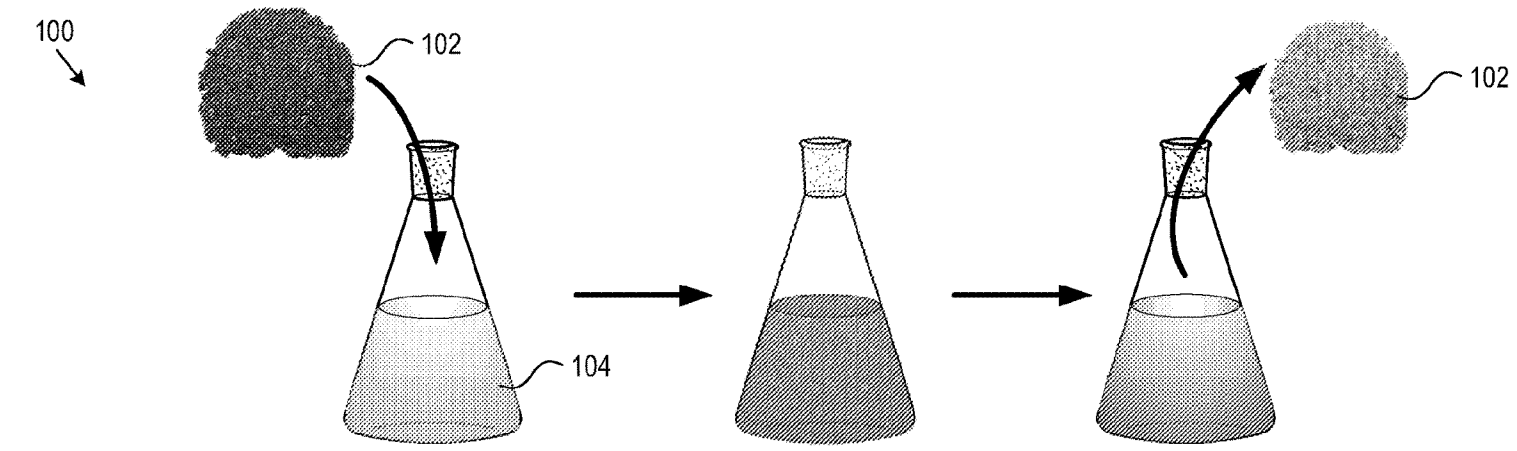
FIGS. 1A and 1B show renders of a method to extract components from a metal-containing material, in accordance with an exemplary embodiment of the present disclosure.

To facilitate an understanding of the principles and features of the present disclosure, various illustrative embodiments are explained below. The components, steps, and materials described hereinafter as making up various elements of the embodiments disclosed herein are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

Unless defined otherwise, all technical and scientific terms used herein have the same meaning as commonly understood by one of ordinary skill in the art to which this invention belongs.

As used in this specification and the appended claims, the singular forms "a", "an", and "the" include plural references unless the context clearly dictates otherwise. Thus, for example, a reference to "a method" includes one or more methods, and/or steps of the type described herein and/or which will become apparent to those persons skilled in the art upon reading this disclosure.

Ranges can be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, or method steps, even if the other such compounds, material, particles, or method steps have the same function as what is named.

Compounds of the present invention include those described generally herein, and are further illustrated by the classes, subclasses, and species disclosed herein. As used herein, the following definitions shall apply unless otherwise indicated. For purposes of this invention, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausalito: 1999, and "March's Advanced Organic Chemistry", 5th Ed., Ed.: Smith, M. B. and March, J., John Wiley & Sons, New York: 2001, the entire contents of which are hereby incorporated by reference.

The term "aliphatic" or "aliphatic group", as used herein, means a straight-chain (i.e., unbranched) or branched, substituted or unsubstituted hydrocarbon chain that is completely saturated or that contains one or more units of unsaturation or a monocyclic hydrocarbon, bicyclic hydrocarbon, or tricyclic hydrocarbon that is completely saturated or that contains one or more units of unsaturation, but which is not aromatic (also referred to herein as "carbocycle," "cycloaliphatic" or "cycloalkyl"), that has a single point of attachment to the rest of the molecule. Unless otherwise specified, aliphatic groups contain 1-30 aliphatic carbon atoms. In some embodiments, aliphatic groups contain 1-20 aliphatic carbon atoms. In other embodiments, aliphatic groups contain 1-10 aliphatic carbon atoms. In still other embodiments, aliphatic groups contain 1-8 aliphatic carbon atoms, and in yet other embodiments, aliphatic groups contain 1, 2, 3, or 4 aliphatic carbon atoms. Suitable aliphatic groups include, but are not limited to, linear or branched, substituted or unsubstituted alkyl, alkenyl, alkynyl groups and hybrids thereof such as (cycloalkyl)alkyl, (cycloalkenyl)alkyl or (cycloalkyl) alkenyl.

As used herein, the term "alkyl" is given its ordinary meaning in the art and may include saturated aliphatic groups, including straight-chain alkyl groups, branched-chain alkyl groups, cycloalkyl (alicyclic) groups, alkyl substituted cycloalkyl groups, and cycloalkyl substituted alkyl groups. In certain embodiments, a straight chain or branched chain alkyl has about 1-20 carbon atoms in its backbone (e.g., $C_1$-$C_{20}$ for straight chain, $C_2$-$C_{20}$ for branched chain), and alternatively, about 1-10 carbon atoms, or about 1 to 8 carbon atoms. In some embodiments, a cycloalkyl ring has from about 3-10 carbon atoms in their ring structure where such rings are monocyclic or bicyclic, and alternatively about 5, 6 or 7 carbons in the ring structure. In some embodiments, an alkyl group may be a lower alkyl group, wherein a lower alkyl group comprises 1-4 carbon atoms (e.g., $C_1$-$C_4$ for straight chain lower alkyls).

As used herein, the term "alkenyl" refers to an alkyl group, as defined herein, having one or more double bonds.

As used herein, the term "alkynyl" refers to an alkyl group, as defined herein, having one or more triple bonds.

The term "heteroalkyl" is given its ordinary meaning in the art and refers to alkyl groups as described herein in which one or more carbon atoms is replaced with a heteroatom (e.g., oxygen, nitrogen, sulfur, and the like). Examples of heteroalkyl groups include, but are not limited to, alkoxy, poly (ethylene glycol)-, alkyl-substituted amino, tetrahydrofuranyl, piperidinyl, morpholinyl, etc.

The term "unsaturated," as used herein, means that a moiety has one or more units of unsaturation.

The term "halogen" means F, Cl, Br, or I; the term "halide" refers to a halogen radical or substituent, namely —F, —Cl, —Br, or —I.

Unless otherwise stated, all tautomeric forms of the compounds of the invention are within the scope of the invention.

As is employed herein, the term "metals" means rare earth elements, transition metals, and other metals and metalloids in the Periodic Table. Metals which are desirable, and which may be extracted by the method disclosed herein include aluminum, barium, calcium, iron, lithium, potassium, titanium, arsenic, cadmium, cobalt, copper, mercury, manganese, nickel, lead, rubidium, antimony, strontium, yttrium, zirconium, ruthenium, palladium, silver, vanadium, chromium, cesium, dysprosium, europium, lanthanum, praseodymium, promethium, gadolinium, holmium, erbium, lutetium, scandium, selenium, tantalum, terbium, thulium, uranium, zinc, cerium, gallium hafnium, indium, neodymium, samarium, and ytterbium. The process is particularly useful for the extraction of scandium, yttrium, lanthanum, cerium, neodymium, europium, dysprosium, iron and aluminum, among others.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Figure 1B:
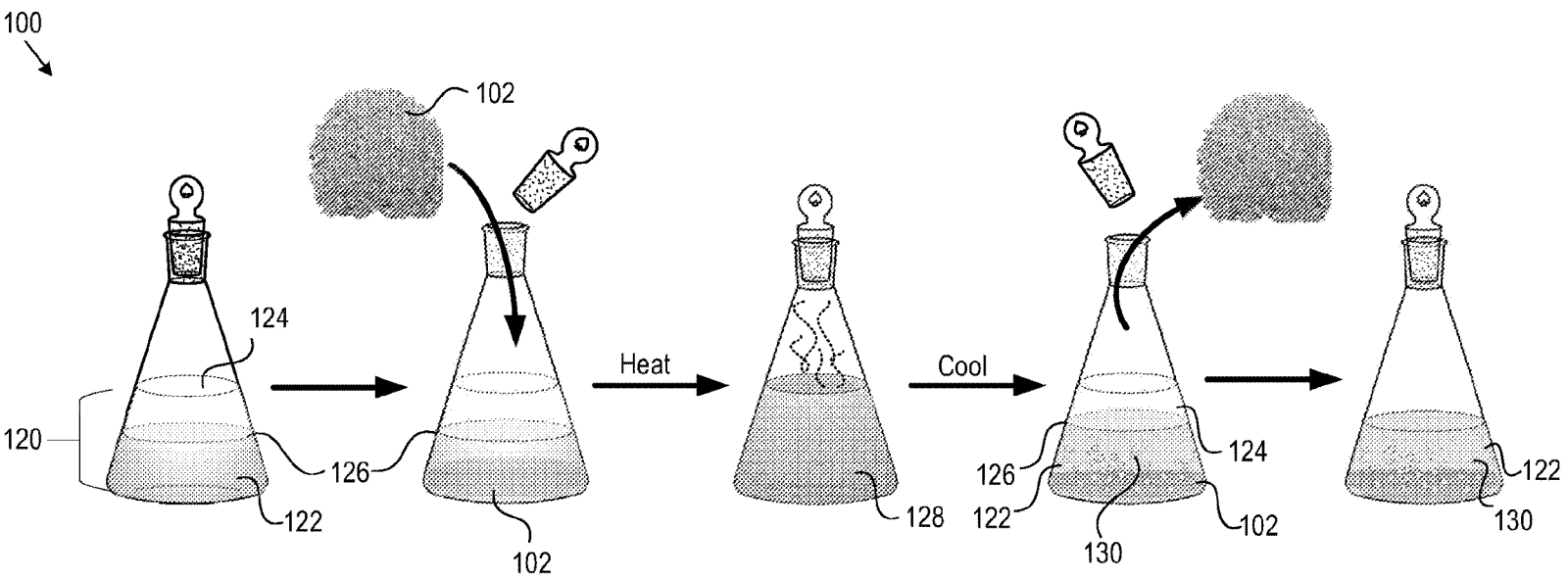
Figure 8A:
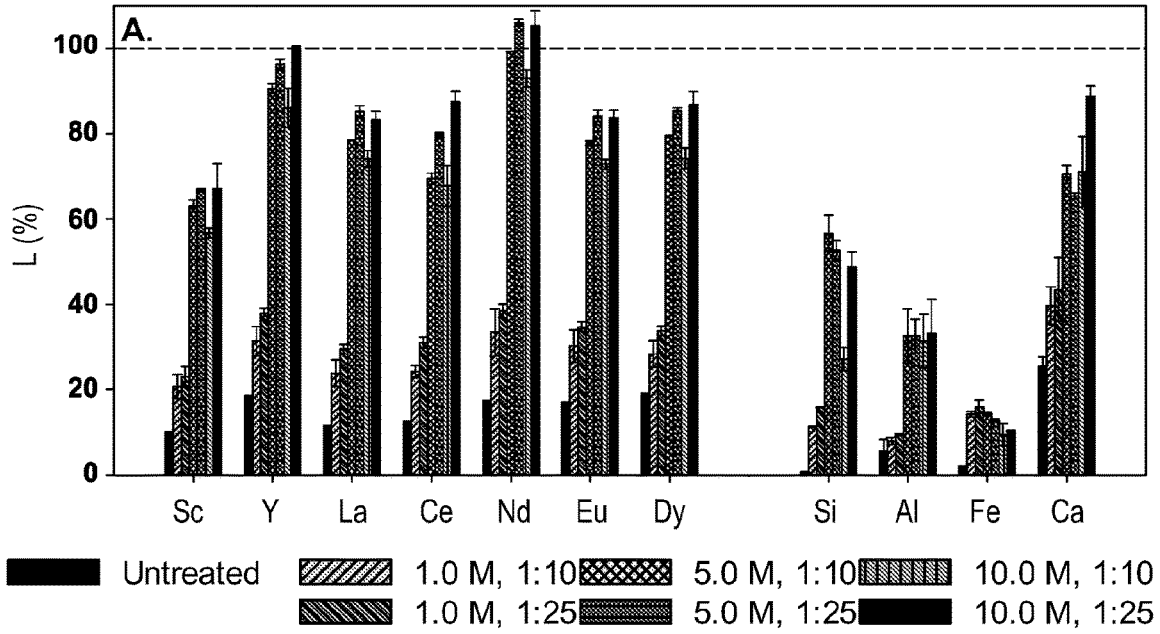
FIG. 8A shows a plot of leaching efficiency (L (%)) of components from pretreated metal-containing material versus type of REE and metal, in accordance with an exemplary embodiment of the present disclosure.
Figure 8B:
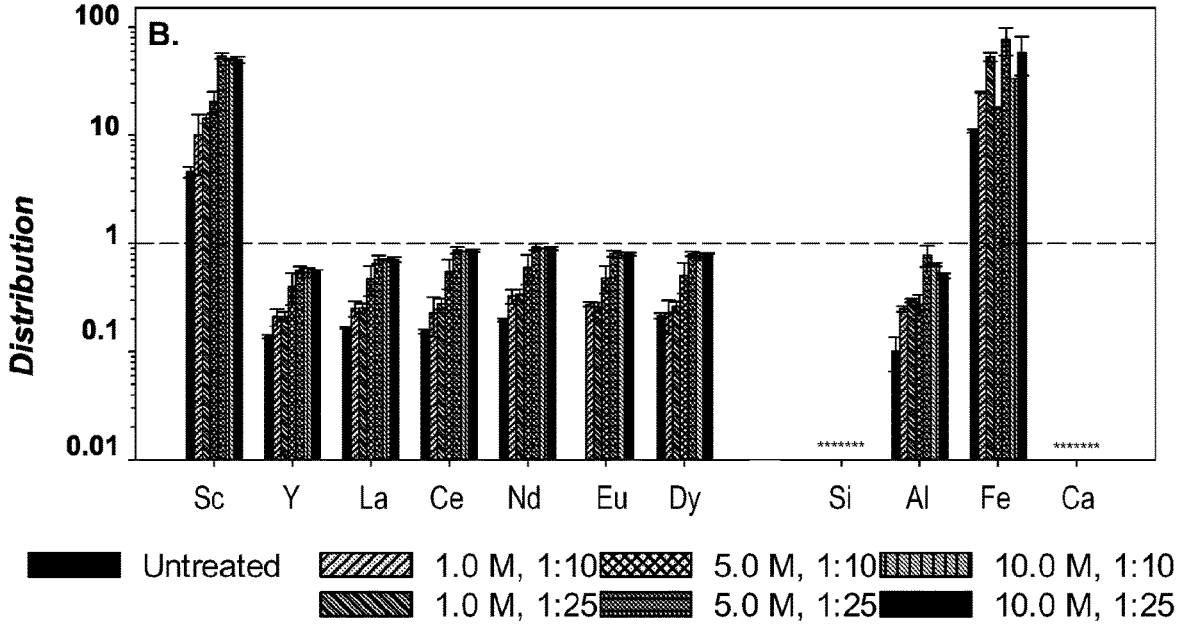
FIG. 8B shows a plot of distribution of components after extraction from pretreated metal-containing material versus type of REE and metal, in accordance with an exemplary embodiment of the present disclosure.

As shown in FIGS. 1A and 1B, an exemplary embodiment of the present disclosure provides a method to extract components from a metal-containing material. FIG. 1A shows the method 100 can comprise providing a metal-containing material 102 and contacting metal-containing material 102 with an alkaline component 104. In some embodiments, contacting metal-containing material 102 with alkaline component 104 constitutes pretreating metal-containing material 102. The term "pretreated," as used herein, means treating a material prior to use in the extraction process. Pretreatment can be done with chemical methods, such as, for example contacting the material with an acidic solution, an alkaline solution, a gas, or catalyst. Pretreatment can also be done using mechanical techniques, such as, for example, heating, pulverizing, powdering, irradiating, fungal or microbial degradation. In some embodiments, alkaline component 104 can be used for pretreating metal containing material 102. Alkaline component 104 can comprise an aqueous solution, including, for example, NaOH, KOH, LiOH, $Ca(OH)_2$, CaO, $Mg(OH)_2$, $NH_4OH$, $NH_3$, and combinations thereof. In any of the embodiments disclosed herein, the concentration of alkaline component 104 can range from about 0.1 M to about 10 M. Concentrations of alkaline component 104 may depend on the ratio of metal-containing material 102 in contact with alkaline component 104. For example, metal-containing material 102 may be pretreated in an aqueous solution of 1.0 M NaOH at a ratio of 1:10 g/ml (grams of metal-containing material per ml of alkaline component). In another example, metal-containing material 102 may be pretreated with an aqueous solution of 1.0 M NaOH at a 1:25 g/ml ratio; 5.0 M NaOH at a 1:10 g/ml ratio; 5.0 M NaOH at a 1:25 g/ml ratio; 10.0 M NaOH at a 1:10 g/ml ratio; or 10.0 M NaOH at a 1:25 g/ml ratio (FIGS. 8A and 8B).

According to some embodiments, alkaline component 104 can comprise a second component. The second component can be a reductant, such as, for example, ascorbic acid, hydroxylamine, hydroquinone, sodium dithionite, sodium dithionate, potassium dithionate, barium dithionate, sulfur dioxide, sodium sulfite, hydrogen sulfide, sodium thiosulfate, hydrazine, iodide, and sodium borohydride.

Metal-containing material 102 can comprise a combustion by-product poor in REE concentration such as, for example, coal ash, fly ash, bottom ash, incineration ash, unrefined mineral ores, metal oxides, clays, particulate matter, soot, black carbon and combinations thereof. REE-poor metal-containing material 102 can comprise less than about 10% (by weight) of one or more metals, including rare earth elements. In some embodiments, metal-containing material 102 can comprise a concentration of one or more metals from about 0.001 ppm to about 100,000 ppm of each one or more metal, such as, for example, Fe can be present in about 10% by weight or about 100,000 ppm in coal by-products. In certain embodiments, metal-containing material 102 can comprise a concentration of one or more metals from about 0.001 ppm to about 1,000 ppm of each one or more metal. For example, in about 75 grams of a bituminous coal fly ash sample, REEs such as Dy, Eu, La, and U can be present in about 18.7 ppm, 4.6 ppm, 87 ppm, and 9.2 ppm, respectively.

The metal can be one or more of Ba, Fe, Ti, As, Cd, Co, Cu, Hg, Mn, Ni, Pb, Rb, Sb, Sr, V, U, Ce, Dy, Er, Eu, Gd, Ho, La, Lu, Nd, Pr, Pm, Sm, Sc, Se, Tb, Th, Tm, Yb, and Y. Metal-containing material 102 composition can be dependent on the combustion precursor product burned and the combustion conditions used. For example, combustion conditions at individual power plants can have a significant impact on the composition of metal-containing material 102. Such conditions can include, but are not limited grinding mill efficiency, combustion environment temperature and oxygen supply, boiler configuration, rate of particle cooling, and combinations thereof. Rate of particle cooling of metal-containing material 102 can impact particle size, shape, and mineralogy. For example, a rapidly cooled particles may be heterogeneous mixtures of amorphous glass containing quartz, mullite, gypsum, and various iron mineral phases. Further, different metal-containing material 102 ash type may comprise REEs or other metals distributed among different glass phases. For example, a Class F sample may include only 30% of REEs in glass phases with 40% distributed in apatite phases, 20% in phosphate and hematite, and 10% in oxide and carbonate phases. In another example, a Class C sample may include 50-60% of REEs in REE oxides, 20-30% in apatite and 20% in REE phosphates and hematite.

FIG. 1B shows method 100 can further comprise forming a first multicomponent system 120. First multicomponent system 120 can have an ionic liquid 122 and a first aqueous component 124, wherein the first aqueous component 124 and the ionic liquid 122 form an immiscible mixture 126 when first multicomponent system 120 is at a temperature below a critical temperature and/or at a pH above a critical pH value. The multicomponent system may include a homogeneous mixture or a heterogenous mixture dependent on conditions such as temperature, pressure, concentration of a component, and/or pH. As used herein, "immiscible" means naturally resisting, or being incapable of blending or combining homogeneously. Immiscible mixtures normally cannot be blended together or can be blended only slightly.

Ionic liquid 122 may be also be referred to as liquid electrolytes, ionic melts, ionic fluids, fused salts, liquid salts, or ionic glasses. In some embodiments, ionic liquid 122 may be a room-temperature ionic liquid of a task-specific ionic liquid, such. Task-specific ionic liquids can have properties such as negligible vapor pressure, low flammability, high thermal stability, broad electrochemical window, and high liquidus range. Task-specific ionic liquids can also have behaviors such as, for example, thermomorphic, pH-morphic, or concentration-morphic behavior depending on conditions of multicomponent system 120. Ionic liquid 122 can comprise one or more of the following structures:

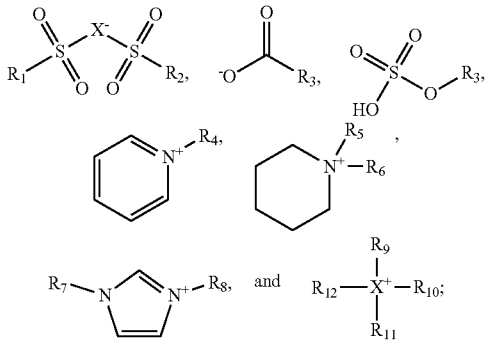

wherein:

X is N or P;

$R_1$ and $R_2$ are each independently selected from H, OH, or $CF_3$;

$R_3$ is:

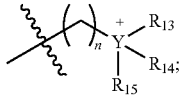

$R_4$-$R_8$ are each independently selected from H, substituted or unsubstituted $C_{1-8}$ alkyl;

$R_9$-$R_{12}$ are each independently selected from substituted or unsubstituted $C_{1-10}$ alkyl or $(C_{1-10})$—OH;

Y is N or P;

n is an integer ranging from 1 to 8; and $R_{13}$, $R_{14}$, and $R_{15}$ are each independently selected from H, substituted or unsubstituted $C_{1-8}$ alkyl.

Ionic liquid 122 can comprise at least one cation and at least one anion. Ionic liquid 122 may comprise many functional groups covalently bonded to cationic or anionic parts of a cation or anion. The functional groups can include carboxylic acid, sulfonic acid, alkylsulfuric acid, choline, bis(trifluoromethylsulfonyl)imide, hexafluorophosphate, tetrafluoroborate, nitrate, triflate, mesylate, chloride, and the like. The functional group may coordinate to metal ions as a monodentate, bidentate, or polydentate ligand.

Ionic liquid 122 can comprise a cation with a carboxyl-functional group, such as, for example, betainium, N-butyl-N-dimethylbetainium, N-hexyl-N-dimethylbetanium, N-carboxymethyl-N-methylpyrrolidinium, N-carboxymethyl-N-methylpiperidinium, N-carboxymethyl-N-methylmorpholinium, N-carboxymethylpyridinium, or 1-carboxymethyl-3-methylimidazolium.

Ionic liquid 122 can comprise a cation with a sulfonic acid functional group, such as, for example, N,N,N-trimethyl-3-sulfopropan-1-aminium, N,N,N-trimethyl-4-sulfobutan-1-aminium, N,N,N-triethyl-3-sulfopropan-1-aminium, N,N,N-triethyl-4-sulfobutan-1-aminium, N,N,N-tripropyl-3-sulfopropan-1-aminium, or N,N,N-tripropyl-4-sulfobutan-1-aminium.

Ionic liquid 122 can comprise a cation with an alkylsulfuric acid functional group, such as, for example, N,N,N-trimethyl-2-(sulfooxy) ethan-1-aminium, N,N,N-triethyl-2-(sulfooxy) ethan-1-aminium, N,N-dihexyl-N-(2-(sulfooxy) ethyl) hexan-1-aminium, or N,N-dioctyl-N-(2-(sulfooxy) ethyl) octan-1-aminium.

Ionic liquid 122 can comprise a cation with a choline functional group, such as, for example, choline or N,N,N-triethyl-2-hydroxyethane-1-aminium.

In some embodiments, ionic liquid 122 can comprise a piperidinium cation such as for example, 1-butyl-1-methylpiperidinium, 1-methyl-1-propylpiperidinium.

Ionic liquid 122 can comprise a phosphonium cation, such as, for example, trioctyl (2-(sulfooxy) ethyl) phosphonium, tributyl (2-(sulfooxy) ethyl) phosphonium, or trihexyltetradecylphosphonium.

Ionic liquid 122 can comprise an imidazolium cation, such as, for example, 1-methyl-3-methyl imidazolium or 1-ethyl-3-methyl imidazolium.

In some embodiments, ionic liquid 122 can comprise an anion having a bistriflimide or bis(trifluoromethylsulfonyl) imide functional group, such as, for example, bis(trifluoromethanesulfonyl)aniline.

Ionic liquid 122 can comprise an anion having a triflate functional group, such as, for example, methyl trifluoromethanesulfonate, ethyl trifluoromethanesulfonate, or N,N-bis(trifluoromethanesulfonyl)aniline.

Ionic liquid 122 can comprise an anion having a mesylate functional group, such as, for example, methyl mesylate, ethyl meslyate, or 1-ethyl-3-methylimidazolium mesylate.

Ionic liquid 122 can also comprise anions having a hexafluorophosphate, tetrafluoroborate, nitrate or chloride functional group.

In some embodiments, ionic liquid 122 can comprise betaine bis(trifluoromethylsulfonyl)imide ("[H(bet)][$Tf_2$N]").

First aqueous component 124 can comprise an aqueous solution having salts, acidic components, or alkaline components. As used herein, "aqueous component" means water or an aqueous solution, regardless of ingredients within the aqueous component. In some embodiments, first aqueous component 124 can comprise one or more salts. In some embodiments, salts are soluble within first aqueous component 124. Salts can be nitrates, halides, carbonates, chlorates, and perchlorates.

Salts of nitric acid contain the anion $NO_3$ and form salts with a wide range of elements on the Periodic table. Nitrate salts are can include, $NaNO_3$, $KNO_3$, $LiNO_3$, $NH_3NO_3$, $Be(NO_3)_2$, $Mg(NO_3)_2$, $Ca(NO_3)_2$, $Sr(NO_3)_2$, $Ba(NO_3)_2$, $Zn(NO_3)_2$, $Ni(NO_3)_2$, $Fe(NO_3)_2$, $Cu(NO_3)_2$, $Al(NO_3)_3$, $Fe(NO_3)_3$, $Pb(NO_3)_2$, $AgNO_3$, $AuNO_3$, and combinations thereof.

Similarly, salts of halides are also known as halide minerals and contain fluoride, chloride, bromide, or iodide anions and form salts with a wide range of elements on the Periodic table. Halide salts can include LiF, NaF, KF, $NH_4F$, $BeF_2$, $MgF_2$, $SrF_2$, $BaF_2$, $ZnF_2$, $NiF_2$, $FeF_2$, $CuF_2$, $AlF_3$, $FeF_3$, $PbF_2$, AgF, AuF, LiCl, NaCl, KCl, $NH_4Cl$, $BeCl_2$, $MgCl_2$, $SrCl_2$, $BaCl_2$, $ZnCl_2$, $NiCl_2$, $FeCl_2$, $CuCl_2$, $AlCl_3$, $FeCl_3$, $PbCl_2$, AuCl, LiBr, NaBr, KBr, $NH_4Br$, $BeBr_2$, $MgBr_2$, $SrBr_2$, $BaBr_2$, $ZnBr_2$, $NiBr_2$, $FeBr_2$, $CuBr_2$, $AlBr_3$, $FeBr_3$, $PbBr_2$, AuBr, LiI, NaI, KI, $NH_4I$, $MgI_2$, $SrI_2$, $BaI_2$, $ZnI_2$, $NiI_2$, $FeI_2$, $AlI_3$, $PbI_2$, and combinations thereof.

Salts of carbonate contain the anion $CO_3^{2-}$ and form salts with some elements on the Periodic table. Carbonate salts generally act as weak bases and can participate in acid-base reactions. Carbonate salts can include $Li_2CO_3$, $Na_2CO_3$, $K_2CO_3$, $(NH_4)_2CO_3$, $BaCO_3$, and combinations thereof.

Salts of chlorate contain the anion ClO; and form salts with a wide range of elements on the Periodic table. Chlorate salts can include $NaClO_3$, $KClO_3$, $LiClO_3$, $NH_4ClO_3$, $Mg(ClO_3)_2$, $Ca(ClO_3)_2$, $Sr(ClO_3)_2$, $Ba(ClO_3)_2$, $Zn(ClO_3)_2$, $Ni(ClO_3)_2$, $Fe(ClO_3)_2$, $Cu(ClO_3)_2$, $Al(ClO_3)_3$, $Fe(ClO_3)_3$, $Pb(ClO_3)_2$, $AgClO_3$, $AuClO_3$, and combinations thereof.

Salts of perchlorate contain the anion $ClO_4$ and form salts with a wide range of elements on the Periodic table. Perchlorate salts can be strong oxidizers. Perchlorate salts can include $NaClO_4$, $KClO_4$, $NH_4ClO_4$, and combinations thereof.

According to some embodiments, first aqueous component 124 can be acidic. In some embodiments, first aqueous component 124 can be a pH value from about 2.5 to about 5.5. In another embodiment, pH is from about 2.5 to about 3.0, or from about 3.0 to about 3.5, or from about 3.5 to about 4.0, or from about 4.0 to about 4.5, or from about 4.5 to about 5.0, or from about 5.0 to about 5.5.

As shown in FIG. 1B, method 100 can comprise contacting metal-containing material 102 with first multicomponent system 120. In some embodiments, metal-containing material 102 can be pretreated with alkaline component 104 prior to contacting with first multicomponent system 120. In another embodiment, metal-containing material 102 may be pretreated with other chemical or mechanical methods prior to contacting with first multicomponent system 120. Alternatively, method 100 may comprise contacting untreated metal-containing material 102 with first multicomponent system 120.

Method 100 can further comprise adjusting the temperature of first multicomponent system 120 above the first critical temperature of first multicomponent system to form a miscible mixture 128. As used herein, "critical temperature" means a property in that when temperature of a multicomponent system is increased passed an upper critical temperature, a structural change of the multicomponent system occurs at such critical temperature or above. At a temperature above the critical temperature, the components of a multicomponent system are miscible in all proportions. Conversely, at a temperature below the critical temperature, the components of a multicomponent system are immiscible. The critical temperature depends on several factors, such as, for example, the ratio of ionic liquid 122 to first aqueous component 124, types of salts or concentration of salts, or other presence of other elements, such as metal ions. As would be understood by one of skill in the art, presence of other elements, such as metal ions, could disrupt the crystallinity of ionic liquid 122. The presence of more salts and/or other elements may lower the critical temperature.

In some embodiments, first multicomponent system 120 can comprise a first critical temperature from about 30° C. to about 70° C. In some embodiments, first multicomponent system 120 can comprise a critical temperature of around 55° C. to around 60° C. with a weight ratio of 1:1 ionic liquid 122 to first aqueous component 124.

In one embodiment, the ratio of ionic liquid 122 to first aqueous component 124 is from about 0:1 to about 1:1. In one embodiment, the ratio of ionic liquid 122 to first aqueous component 124 is about 0:1 to 1:1, or 0.1:1 to 1:1, or 0.2:1 to 1:1, or 0.3:1 to 1:1, or 0.4:1 to 1:1, or 0.5:1 to 1:1, or 0.6:1 to 1:1, or 0.7:1 to 1:1, or 0.8:1 to 1:1, or 0.9:1 to 1:1, or 0:1 to 0.9:1, or 0:1 to 0.8:1, or 0:1 to 0.7:1, or 0:1 to 0.6:1, or 0:1 to 0.5:1, or 0:1 to 0.4:1, or 0:1:1 to 0.3:1, or 0:1 to 0.2:1, or 0:1 to 0.1:1. In one embodiment, the ratio of ionic liquid 122 to first aqueous component 124 is about 0:1 to 0.9:1, or 0:1 to 0.8:1, or 0:1 to 0.7:1, or 0:1 to 0.6:1, or 0:1 to 0.5:1, or 0:1 to 0.4:1, or 0:1 to 0.3:1, or 0:1 to 0.2:1, or 0:1 to 0.1:1.

In some embodiments, method 100 can comprise adjusting the pH of the first multicomponent system above the critical pH value to form miscible mixture 128 with ionic liquid 122 and first aqueous component 124. Similar to the critical temperature, critical pH value depends on several factors, such as, for example, the ratio of ionic liquid 122 to first aqueous component 124, types of salts or concentration of salts, or other presence of other elements, such as metal ions.

According to some embodiments, first multiple component system 120 can comprise a critical pH value from about 2 to about 8. In some embodiments, the critical pH value is about 2 to about 3, from about 3 to about 4, from about 4 to about 5, from about 5 to about 6, from about 6 to about 7, or from about 7 to about 8.

In some embodiments, method 100 can comprise adding one or more salts to first multicomponent system 120 to create a salt concentration of multicomponent system 120 above a critical salt concentration to form miscible mixture 128 with ionic liquid 122 and first aqueous component 124.

As shown in FIG. 1B, method 100 can further comprise reverting the temperature of first multicomponent system 120 below the first critical temperature and/or pH of first multicomponent system 120 below the critical pH value, to form immiscible mixture 126 with ionic liquid 122 and first aqueous component 124. In some embodiments, first multicomponent system 120 can extract one or more metals 130 from metal-containing material 102. Extracting can take place in miscible mixture 128 when the temperature and/or pH of first multicomponent system 120 is adjusted above the first critical temperature and/or above the critical pH value. In some embodiments, method 100 can further comprise dissolving the one or more extracted metals 130 from metal-containing material 102 into ionic liquid 122. As mentioned above, functional groups within the at least one cation and at least one anion of ionic liquid 122 may coordinate with metal ions.

As shown in FIG. 1B, method 100 can further comprise isolating ionic liquid 122 from first aqueous component 124 and the metal-containing material 102, wherein ionic liquid 122 may comprise one or more metals 130 from metal-containing material 102. Isolating the ionic liquid can comprise common separation techniques, including, but not limited to filtration including gravity filtration, vacuum filtration, hot filtration, cold filtration, multilayer filtration, and centrifugal filtration; decantation; centrifugation, such as density gradient centrifugation, differential centrifugation, or ultra-centrifugation; distillation, such as simple distillation, fractional distillation, vacuum distillation, and steam distillation; evaporation, including natural circulation evaporation or forced circulation evaporation, and combinations thereof.

Figure 2:
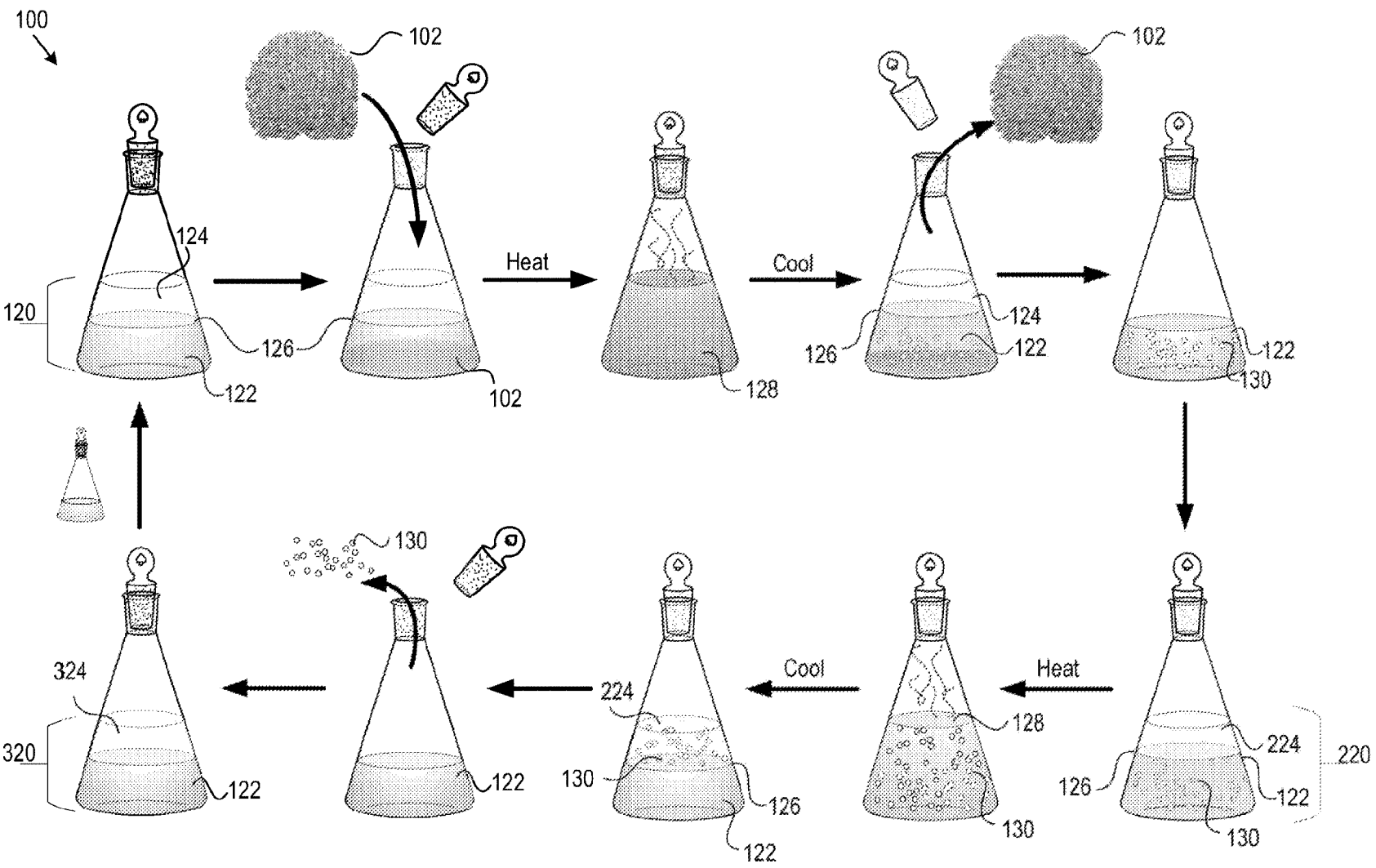
FIG. 2 shows a rendering of a method to extract components from a metal-containing material, in accordance with an exemplary embodiment of the present disclosure.

Referring to FIG. 2, method 100 may further comprise forming a second multicomponent system 220 having ionic liquid 122, previously isolated and having one or more metals 130 from metal-containing material 102, and an acidic component 224. Acidic component 224 and ionic liquid 122 can form immiscible mixture 126 when second multicomponent system 220 is at a temperature below a second critical temperature. As described above, the critical temperature depends on several factors, such as, for example, the ratio of ionic liquid 122 to acidic component 224, types of salts or concentration of salts, or other presence of other elements, such as metal ions. As would be understood by one of skill in the art, the critical temperature of first multicomponent system 120 may be a different critical temperature than second multicomponent system 130. In some embodiments, however, the critical temperature of first multicomponent system 120 may be around the same critical temperature of second multicomponent system 130.

In one embodiment, the ratio of ionic liquid 122 to acidic component 224 is from about 0:1 to about 1:1. In one embodiment, the ratio of ionic liquid 122 to acidic component 224 is about 0:1 to 1:1, or 0.1:1 to 1:1, or 0.2:1 to 1:1, or 0.3:1 to 1:1, or 0.4:1 to 1:1, or 0.5:1 to 1:1, or 0.6:1 to 1:1, or 0.7:1 to 1:1, or 0.8:1 to 1:1, or 0.9:1 to 1:1, or 0:1 to 0.9:1, or 0:1 to 0.8:1, or 0:1 to 0.7:1, or 0:1 to 0.6:1, or 0:1 to 0.5:1, or 0:1 to 0.4:1, or 0:1:1 to 0.3:1, or 0:1 to 0.2:1, or 0:1 to 0.1:1. In one embodiment, the ratio of ionic liquid 122 to acidic component 224 is about 0:1 to 0.9:1, or 0:1 to 0.8:1, or 0:1 to 0.7:1, or 0:1 to 0.6:1, or 0:1 to 0.5:1, or 0:1 to 0.4:1, or 0:1 to 0.3:1, or 0:1 to 0.2:1, or 0:1 to 0.1:1.

In some embodiments, acidic component 224 can comprise an aqueous solution. Acidic component 224 can include HCl, $HTf_2N$, $HNO_3$, $H_3PO_4$, $H_2SO_4$, $H_3BO_3$, HF, HBr, $HClO_4$, HI, and combinations thereof. In some example embodiments, acidic component 224 can alternatively or also comprise a solid, such as oxalic acid, citric acid, tartaric acid, maleic acid, formic acid, acetic acid, trichloroacetic acid, hydrocyanic acid, and combinations thereof. When acidic component 224 comprises a solid, the solid first dissolved into ionic liquid 122 and then can precipitate out metal-acid salt complexes as solids, such as, for example, metal-oxalate complexes.

Acidic component 224 can have a pH value from about −1 to about 6.5, depending on the acid and concentration of acid used.

As shown in FIG. 2, method 100 can comprise adjusting the temperature of second multicomponent system 220 above the second critical temperature to form miscible mixture 128 with ionic liquid 122 and acidic component 224.

In some embodiments, method 100 can further comprise reverting the temperature of second multicomponent system 220 below the second critical temperature to form immiscible mixture 126 with ionic liquid 122 and acidic component 224.

Method 100 additionally comprises isolating the one or more metals 130 from second multicomponent system 220. In some examples, after reverting the temperature of second multicomponent system 220 below the second critical temperature, the one or more metals 130 dissolved in ionic liquid 122 can be extracted into acidic component 224. Isolating the one or more metals 130 from second multicomponent system 220 can comprise common separation techniques, including, but not limited to filtration, decantation, centrifugation, distillation, precipitation, calcination, evaporation, or application of an electrical potential.

As shown in FIG. 2, method 100 can additionally comprise, after isolating the one or more metals 130 from second multicomponent system 220, isolating ionic liquid 122 from second multicomponent system 220 and contacting isolated ionic liquid 122 with a second aqueous component 324 to form a third multicomponent system 320.

Second aqueous component 324 can comprise an aqueous solution, such as, for example, water with or without the addition of one or more salts, acidic components, or alkaline components. In some embodiments, second aqueous component 324 replenishes ionic liquid 122 such that ionic liquid 122 can be reused or recycled in method 100 for extracting components, such as metals or REEs from metal-containing materials again.

In one embodiment, the ratio of ionic liquid 122 to second aqueous component 324 is from about 0:1 to about 1:1. In one embodiment, the ratio of ionic liquid 122 to second aqueous component 324 is about 0:1 to 1:1, or 0.1:1 to 1:1, or 0.2:1 to 1:1, or 0.3:1 to 1:1, or 0.4:1 to 1:1, or 0.5:1 to 1:1, or 0.6:1 to 1:1, or 0.7:1 to 1:1, or 0.8:1 to 1:1, or 0.9:1 to 1:1, or 0:1 to 0.9:1, or 0:1 to 0.8:1, or 0:1 to 0.7:1, or 0:1 to 0.6:1, or 0:1 to 0.5:1, or 0:1 to 0.4:1, or 0:1:1 to 0.3:1, or 0:1 to 0.2:1, or 0:1 to 0.1:1. In one embodiment, the ratio of ionic liquid 122 to second aqueous component 324 is about 0:1 to 0.9:1, or 0:1 to 0.8:1, or 0:1 to 0.7:1, or 0:1 to 0.6:1, or 0:1 to 0.5:1, or 0:1 to 0.4:1, or 0:1 to 0.3:1, or 0:1 to 0.2:1, or 0:1 to 0.1:1.

According to some embodiments, extraction efficiencies of the presently disclosed method can present an extraction efficiency of 99% or greater (e.g., 99.05% or greater, 99.1% or greater, 99.15% or greater, 99.2% or greater, 99.25% or greater, 99.3% or greater, 99.35% or greater, 99.4% or greater, 99.45% or greater, 99.5% or greater, 99.55% or greater, 99.6% or greater, 99.65% or greater, 99.7% or greater, 99.75% or greater, 99.8% or greater, 99.85% or greater, 99.9% or greater, or 99.95% or greater). In some embodiments, extraction efficiencies greater than 100% may be a result of enrichment in the metal-containing material as a result of pretreatment in the alkaline component.

The following examples further illustrate aspects of the present disclosure. However, they are in no way a limitation of the teachings or disclosure of the present disclosure as set forth herein.

EXAMPLES

The following examples illustrate specific aspects of the instant description. The examples should not be construed as limiting, as the examples merely provide specific understanding and practice of the embodiments and their various aspects.

Example 1: Chemicals and Materials

This Study Examined Three representative CFAs: one unweathered Class-F (CFA-F1), one weathered Class-F (CFA-F2) and one unweathered Class-C (CFA-C1) (TABLE 1). The unweathered CFAs were produced recently and had not been subjected to weathering, while weathered CFA was produced years ago and obtained from an ash storage pond.

Betaine hydrochloride (99%) was obtained from Acros Organics. Lithium bis(trifluoromethane)sulfonimide lithium (99.95% purity) was obtained from Sigma Aldrich and lolitec. Sodium nitrate (99.0%) was obtained from Alfa Aesar. Concentrated hydrochloric acid (37 wt. %, 99.999% trace metals basis) and concentrated nitric acid (70% wt. %, 99.999% trace metals basis) were obtained from Sigma Aldrich. All chemicals were obtained at the highest purity and used without further purification. Deionized water (≥18 mΩ-cm) was produced from a Milli-Q water purification system (Millipore, Billerica, MA, USA).

Figure 13:
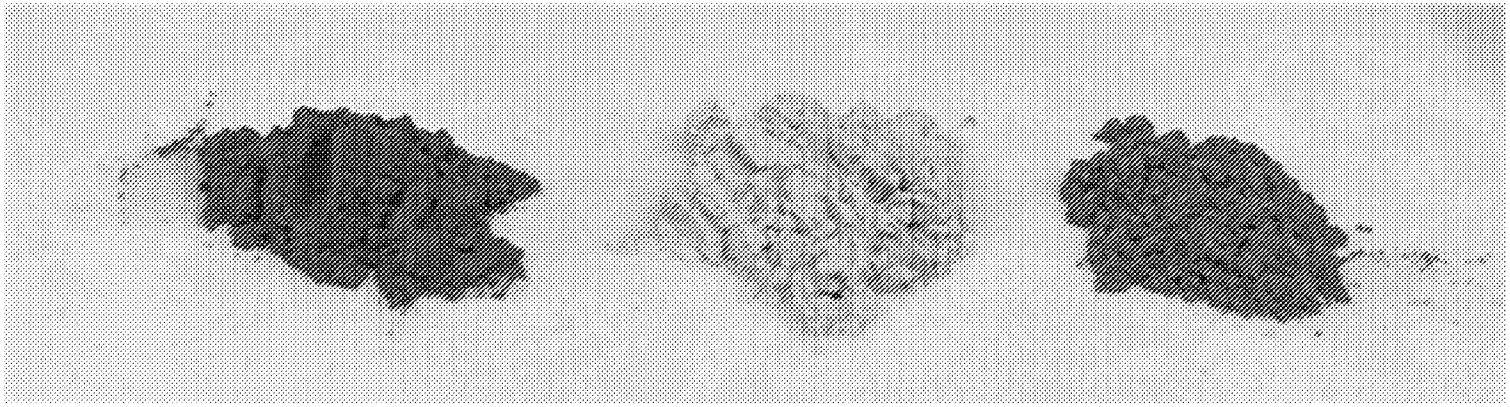
FIG. 13 depicts an image of metal-containing material including coal fly ash samples (CFA)-F1, CFA-C1, and CFA-F2, in accordance with an exemplary embodiment of the present disclosure.
Figure 14:
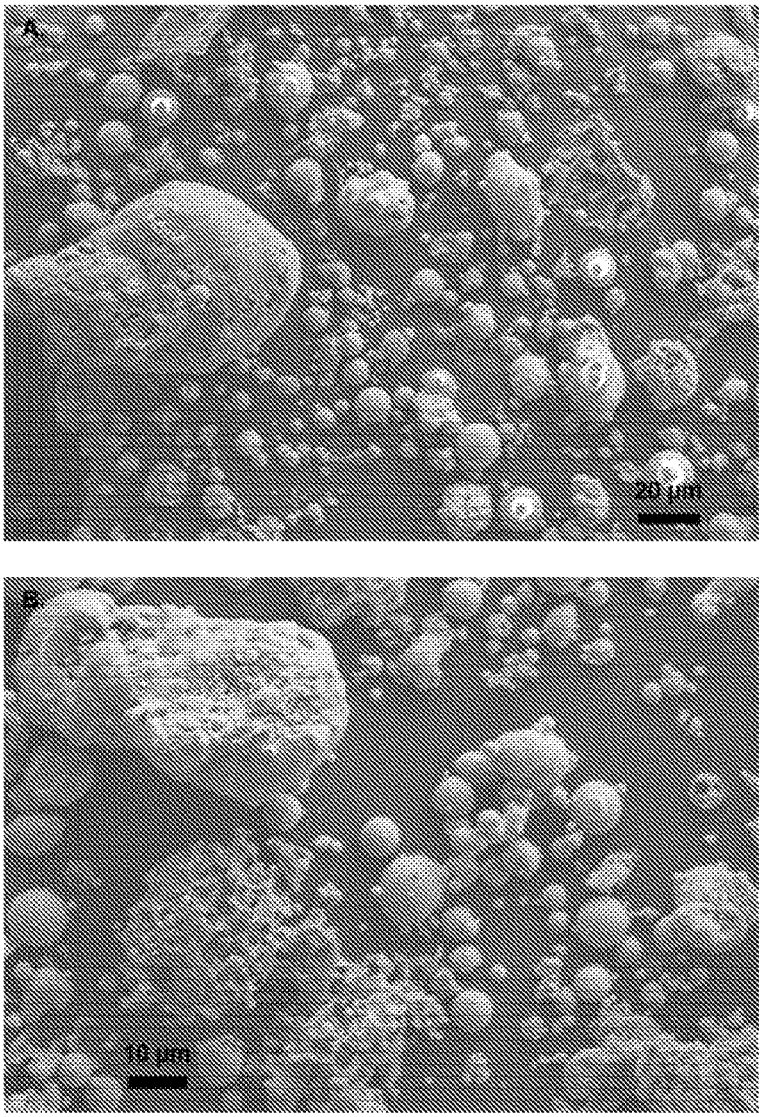
FIGS. 14A and 14B depict SEM images of metal-containing material including CFA-F1, in accordance with an exemplary embodiment of the present disclosure.

This study examined three representative CFAs (FIG. 13): one unweathered Class-F (CFA-F1), one weathered Class-F (CFA-F2) and one unweathered Class-C(CFA-C1). CFA-F1 is the NIST SRM 1633c ash, obtained from Sigma Aldrich. The other two CFA samples were obtained from industry partners. CFA-F2 was obtained from an ash pond at a power plant in Georgia that is no longer active. From 1980 to 2015, the pond received both fly ash and bottom ash, another coal combustion residual. After coal combustion, the residual bottom ash and fly ash were hydraulically sluiced to the pond separately then combined at the pond inlet. Samples were taken at depths between 0.15 and 1.5 m (0.5-5 ft) below ground surface in the pond and are likely less than 10 years old based on estimates from ash pond personnel. CFA-C1 was obtained from a power plant in Georgia that is still active and was collected shortly after combustion and stored dry.

TABLE 1

| | CFA-F1 | CFA-F2 | CFA-C1 | | |
|---|---|---|---|---|---|
| Origin | NIST | Power Plant 1 | Power Plant 2 | | |
| CFA type | Class F | Class F | Class C | | |
| Condition | Unweathered | Weathered | Unweathered | | |
| Major Oxide Composition (wt. %) | | | | | |
| $SiO_2$ | 45.6 | 52.4 | 38.4 | | |
| $Al_2O_3$ | 25.1 | 30.5 | 11.9 | | |
| $Fe_2O_3$ | 15 | 8.6 | 5.2 | | |
| POC | 85.7 | 91.5 | 55.5 | | |
| CaO | 1.9 | 1.6 | 25.2 | | |
| REE Composition (ppm) | | | | | |
| Ce | 180 | 169.1 | 89.9 | | |
| Dy | 18.7 | 14.3 | 7.3 | | |
| Eu | 4.7 | 3 | 2 | | |
| La | 87 | 86.5 | 53.3 | | |
| Nd | 87 | 95.5 | 55.5 | | |
| Sc | 37.6 | 39.7 | 20.6 | | |
| Y | 105.2 | 91.4 | 43.7 | | |
| Σ REEs | 520.2 | 499.4 | 272.2 | | |
| Mineralogy (wt %) | | | | | |
| | a | b | c | a | a |
| Quartz (Q) | 7.5 | 7.2 | 0.3 | 6.5 | 7.7 |
| Mullite (M) | 14.4 | 16.9 | 38.9 | 15.0 | 13.8 |
| Amorphous | 73.9 | 61.8 | 58.2 | 68.2 | 64.4 |
| Sillimanite (L) | 1.3 | — | 0.8 | 5.7 | — |
| Hematite (H) | 0.8 | 5..4 | 1.8 | — | — |
| Magnetite | — | — | — | — | 7.7 |
| Berlinite | — | — | — | 4.6 | — |
| Chlorocalcite | — | — | — | — | 6.4 |
| Sodium aluminum silicate hydrate (S) | — | 8.8 | — | — | — |

*Note:
a. untreated;
b. after 5.0M NaOH pretreatment;
c. after ionic liquid leaching.
Major oxide composition and REE composition are for untreated CFAs.

Example 2: Ionic Liquids

Ionic liquid synthesis. [Hbet][$Tf_2N$] was synthesized in a one-step method.

Aqueous solutions of betaine chloride (HbetCl) and lithium bis(trifluoromethylsulfonyl)imide (Li$Tf_2N$) were prepared to achieve an equimolar ratio of Hbet:$Tf_2N$ and combined at room temperature while stirring. After one hour, the aqueous phase was separated from the ionic liquid phase. The ionic liquid phase was then washed with small aliquots of cold deionized water to remove chloride impurities. Washing was deemed complete when no chloride impurities were detected using the silver nitrate test. Dry ionic liquid was obtained by drying using a vacuum centrifuge at 70° C. [Hbet][$Tf_2N$] is hygroscopic and absorbs 13% water by mass. To achieve a resultant mixture water content of 13% by mass, deionized water was added. ionic liquid samples were stored as water saturated samples (13% by mass) sealed at room temperature.

Figure 3A:
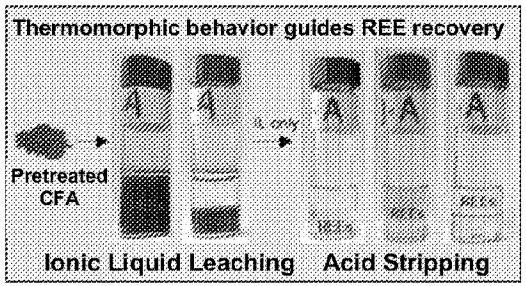
FIG. 3A shows an image of a method to extract compounds from a metal-containing material, in accordance with an exemplary embodiment of the present disclosure.
Figure 3B:
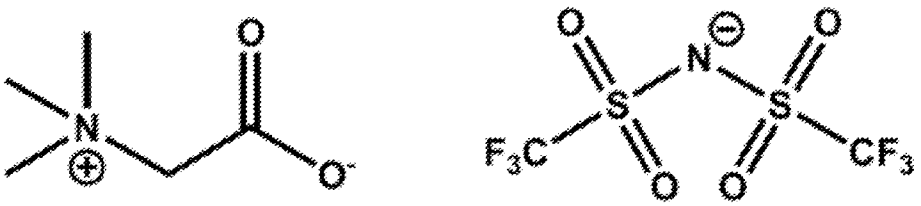
FIG. 3B shows an example ionic liquid, in accordance with an exemplary embodiment of the present disclosure.

Betainium bis(trifluoromethylsulfonyl)imide, commonly referred to as [Hbet][$Tf_2N$] (FIG. 3B), is unique among ionic liquids because it demonstrates thermomorphic solubility with water: at room temperature, it is slightly hygroscopic and absorbs approximately 13% water by mass; but as temperatures increase, its water solubility increases, and above 55° C., becomes fully miscible with water and forms one phase (Vander Hoogerstraete, T.; Onghena, B.; Binnemans, K., Homogeneous liquid-liquid extraction of rare earths with the betaine-betainium bis(trifluoromethylsulfonyl)imide ionic liquid system. Int. J. Mol. Sci. 2013, 14, (11), 21353-77; Vander Hoogerstraete, T.; Jamar, S.; Wellens, S.; Binnemans, K., Determination of halide impurities in ionic liquids by total reflection X-ray fluorescence spectrometry. Anal. Chem 2014, 86, (8), 3931-8). This behavior makes it effective for partitioning metals from aqueous solutions as well as directly from solids: aqueous-ionic liquid mixtures or aqueous-ionic liquid-solid mixtures are heated to form one liquid phase, and then cooled to form two liquid phases, with leached elements partitioning between the liquid phases (Dupont, D.; Binnemans, K., Rare-earth recycling using a functionalized ionic liquid for the selective dissolution and revalorization of $Y_2O_3$: $Eu^{3+}$ from lamp phosphor waste. Green Chem. 2015, 17, (2), 856-868; Dupont, D.; Binnemans, K., Recycling of rare earths from NdFeB magnets using a combined leaching/extraction system based on the acidity and thermomorphism of the ionic liquid [Hbet][$Tf_2N$]. Green Chemistry 2015, 17, (4), 2150-2163). Elements in the ionic liquid phase can be stripped using mildly acidic solutions. Subsequent research found that [Hbet][$Tf_2N$] could selectively solvate solid metal oxides. In particular, REE oxides are highly soluble by [Hbet][$Tf_2N$], but oxides of iron, aluminum, silicon, or uranium are not. Leaching occurs via a proton-exchange mechanism (Eq. 1):

$$REE_2O_3+G[Hbet][Tf_2N] \leftrightarrow 2[REE(bet)_3][(Tf_2N)_3]+3H_2O \quad (I)$$

Previous studies have found that [Hbet][$Tf_2N$] could successfully leach Y and Eu cations from lamp phosphors, Nd from NdFeB magnets, and Sc from bauxite residue (Dupont, D.; Binnemans, K., Rare-earth recycling using a functionalized ionic liquid for the selective dissolution and revalorization of $Y_2O_3:Eu^{3+}$ from lamp phosphor waste. *Green Chem.* 2015, 17, (2), 856-868; Dupont, D.; Binnemans, K., Recycling of rare earths from NdFeB magnets using a combined leaching/extraction system based on the acidity and thermomorphism of the ionic liquid [Hbet][Tf2N]. *Green Chemistry* 2015, 17, (4), 2150-2163; Onghena, B.; Borra, C. R.; Van Gerven, T.; Binnemans, K., Recovery of scandium from sulfation-roasted leachates of bauxite residue by solvent extraction with the ionic liquid betainium bis(trifluoromethylsulfonyl)imide. *Sep. Purif. Technol.* 2017, 176, 208-219). Importantly, CFA presents significantly different challenges than REE-containing solutions or previously studied REE-rich wastes. In CFA, REEs are partitioned into both mineral and amorphous phases, and there is high variability across CFA samples. Notably, most reported data describe unweathered CFAs; there is a dearth of data on REE partitioning in weathered CFAs. To date, ionic liquids have not been applied directly to CFAs. Extensive literature search found one recent study that applied several ionic liquids to CFA leachates, produced via digestion with strong acids (concentrated/undiluted HF, HCL, and $HNO_3$), and achieved low REE recovery (37.4%). Bulk elements (Al, Ca, Si) were co-extracted.

Example 3: CFA Pretreatment

Small glass vials were filled with 50 mg of CFA and a fixed amount of pretreatment solution. A small magnetic stir bar was added to each vial, and the ash-solution mixtures were stirred in an oil bath heated to 85° C. for five hours. After cooling, the vials were centrifuged for 30 minutes and the supernatant was removed. The supernatant was diluted with 5% $HNO_3$ and analyzed by inductively coupled plasma-optical emission spectrometry (ICP-OES) to quantify loss from pretreatment. The remaining ash particles were washed using small amounts of deionized water, filtered using a Buchner funnel with 0.22 μm Whatman filter paper, and dried in a low temperature oven (~80° C.) prior to analysis.

Major oxide composition was determined by X-ray fluorescence (XRF) spectrometry using a Bruker Tracer III and analyzed using SP1XRF software. Mineral composition was determined using powder x-ray diffraction using a Cu—K alpha radiation source (Panalytical XPert PRO Alpha-1 XRD). Rutile was used as an internal standard for phase quantification. Phase quantification was performed using an automatic Rietveld analysis in the HighScore XRD analysis software by Malvern Panalytical. A scanning electron microscope with electron-dispersive spectroscopy (SEM-EDS) (Zeiss Ultra60 FE-SEM) was used to image and map elemental composition of discrete CFA particles. For trace metal composition, CFA samples were digested following the EPA Method 3052. The samples were then diluted with 5% HNO; and analyzed by inductively coupled plasma-optical emission spectrometry (ICP-OES) (PerkinElmer Optima 8000). Accuracy was checked against digestion of a NIST standard CFA sample (SRM 1633c). The detection limit for REEs and Fe was around 1 μg/L; the detection limit for Al, Ca, and Si was 10 μg/L.

Example 4: Leaching and Stripping Experiments

Figure 3C:
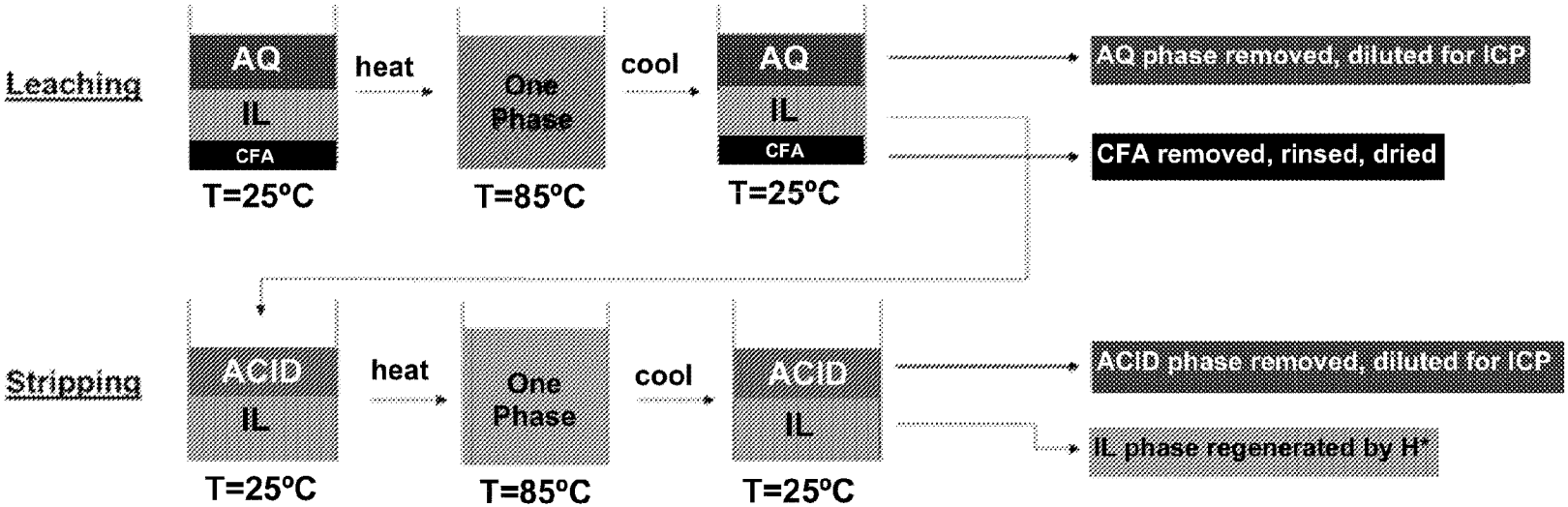
FIG. 3C shows a rendering of a method to extract components from a metal-containing material, in accordance with an exemplary embodiment of the present disclosure.

The leaching and stripping of REEs from CFA followed the schematic shown in FIG. 3C. Small glass vials were filled with 50 mg of CFA, 2.3 g water-saturated ionic liquid, and 1.7 g aqueous solution of 1.0 M $NaNO_3$, achieving an ionic liquid: water ratio of 1:1 by mass. $NaNO_3$ salt was added to promote separation and minimize the mutual solubilities of water and [Hbet][$Tf_2$N]. For some experiments, betaine chloride was also added. The aqueous solution was adjusted with small amounts of $HNO_3$ and NaOH to reach pH 3.50±0.05 prior to mixing with ionic liquid. A small magnetic stir bar was added to each vial, then the vial was shaken vigorously before being placed in an oil bath heated to 85° C. for three hours where the sample was gently stirred continuously by the magnetic stir bar. Upon heating, [Hbet][$Tf_2$N] formed one phase with water. After three hours, the vial was removed from the oil bath and allowed to cool to room temperature before being stored at 4° C. overnight. The phases separated upon cooling.

The aqueous phase was removed and diluted with 5% HNO; before ICP-OES analysis. The ionic liquid phase was transferred to a new vial for stripping. CFA was washed using small amounts of deionized water, collected by filtration using a Buchner funnel with 0.22 μm Whatman filter paper, and dried in a low temperature oven (~75° C.) prior to analysis.

A small magnetic stir bar was added to a new vial containing the ionic liquid layer from the leaching experiments. 1.5 M HCl was added as a stripping phase to achieve a 1:1 mass ratio with the ionic liquid phase. The vial was shaken vigorously before being placed in an oil bath heated to 85° C. for 1.5 hours, where the sample was gently stirred continuously by the magnetic stir bar. Then, the vial was removed and allowed to cool to room temperature before being stored at 4° C. overnight. The stripping phase was then diluted with 5% $HNO_3$ before ICP-OES analysis.

Example 5: Recycling

After stripping, the ionic liquid was reused in another leaching-stripping cycle with a new amount of CFA and aqueous solution, as detailed above, and it was used for a total of three leaching-stripping cycles. Between each cycle, the ionic liquid phase was contacted with two aliquots of cold deionized water, shaken vigorously, and then allowed to separate. The water phases were removed and dilute with 5% $HNO_3$ for ICP-OES analysis. This step removed excess acids from the ionic liquid phase before reuse.

Example 6: Quantification of Extraction and Separation

Elements may be leached from the CFA by the pretreatment ($M_{PT}$) step, and by the ionic liquid/water extraction into the aqueous phase ($M_{AQ}$) and the ionic liquid phase ($M_{ionic\ liquid}$), respectively, where M represents mass. The mass in the ionic liquid phase was determined by that measured in the stripping phase. Previous studies have demonstrated that all elements are completely stripped by the stripping phase from the ionic liquid using HCl at concentrations >1.0 M.

To quantify the extraction and separation of elements from CFA, leaching efficiency (L) and distribution coefficient (D) were calculated. L represents how much an element is extracted by the procedures compared to its total amount ($M_{total}$) in the CFA, as Eq. 2. The total mass of each element in the CFA was determined by total digestion analysis performed in this study or from reported data.

$$L(\text{in }\%) = \frac{M_{PT} + M_{AQ} - M_{IL}}{M_{Total}} \quad (2)$$

D is the ratio between the element's final mass in the ionic liquid phase and its mass in the aqueous phase (AQ), as Eq. 3:

$$D = \frac{M_{IL}}{M_{AO}} \tag{3}$$

All leaching and stripping tests were performed in duplicate. L and D were calculated for elements in each experimental trial and the average were reported Example 7: Characterization of CFAs Major oxide composition and mineral composition were determined by X-ray fluorescence (XRF) spectrometry and powder x-ray diffraction, respectively. Scanning electron microscope with electron-dispersive spectroscopy (SEM-EDS) was used to image and map elemental composition of discrete CFA particles. CFA samples were also digested to determine REE composition and accuracy was checked against digestion of a NIST standard CFA sample (SRM 1633c). The detection limit was around 1.0 ppb for REEs and Fe, and 10 ppb for Al, Ca, and Si in this study.

Figure 15:
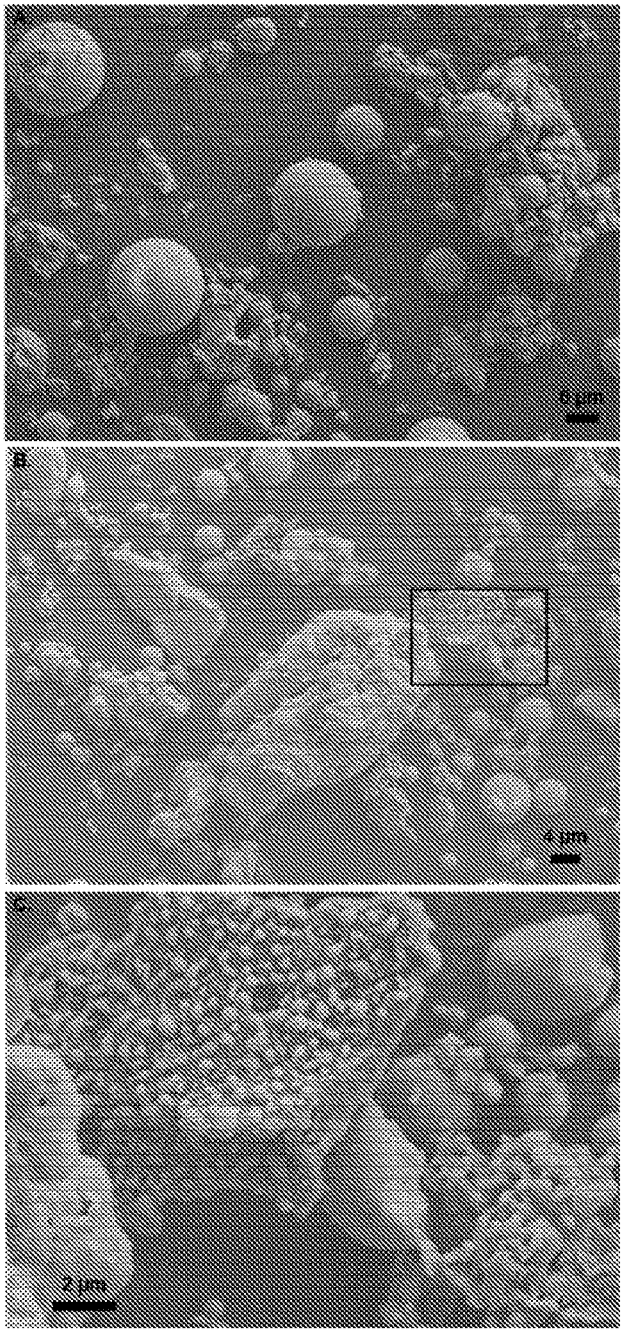
FIGS. 15A-15C depict SEM images of metal-containing material including CFA-F2, in accordance with an exemplary embodiment of the present disclosure.
Figure 16:
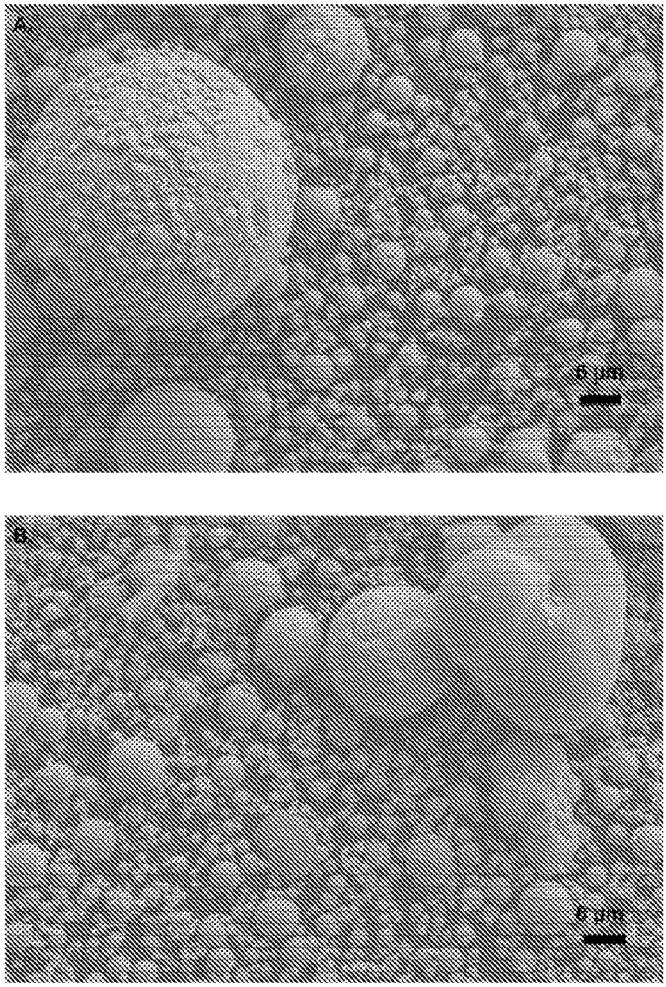
FIGS. 16A and 16B depict SEM images of metal-containing material including CFA-C1, in accordance with an exemplary embodiment of the present disclosure.
Figure 17:
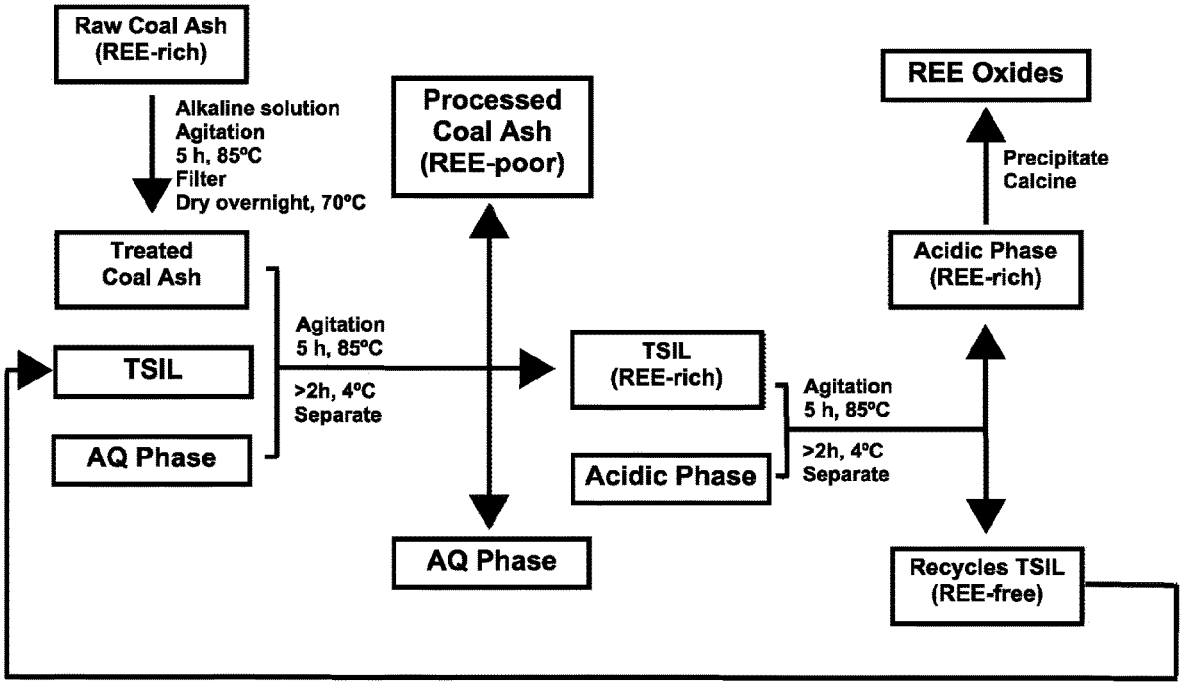
FIG. 17 is a flowchart of a method for extracting components from a metal-containing material, in accordance with an exemplary embodiment of the present disclosure.

The classification of CFAs is based on primary oxide content (POC)—the sum of silicon, aluminum, and iron oxides—and calcium content (ASTM International. *ASTM C618-19: Standard Specification for Coal Fly Ash and Raw or Calcined Natural Pozzolan for Use in Concrete*, West Conshohocken, PA, 2019). Class-F ashes tend to have low calcium content (<15%) and POC>70%, whereas Class-C ashes tend to have high calcium content (15-30%) and POC>50% (Wirth, X.; Glatstein, D. A.; Burns, S. E., Mineral phases and carbon content in weathered fly ashes. *Fuel* 2019, 236, 1567-1576). As shown in TABLE 1, Class-C ashes tend to have lower REE content compared to Class-F ashes, which is reflected in the CFAs in this study. All CFA samples displayed expected physical and morphological properties (McCarthy, G. J.; Solem, J. K.; Manz, O. E.; Hassett, D. J., Use of a database of chemical, mineralogical and physical properties of North American fly ash to study the nature of fly ash and its utilization as a mineral admixture in concrete. *Mat Res Soc Symp* 1990, 178, 3). Most CFAs are fine-grained powders composed of glass aluminosilicate spheres and unburnt carbon particles (FIG. 13, FIGS. 14A and 14B, FIGS. 15A-15C, and FIGS. 16A and 16B). In contrast, weathered CFAs like CFA-F2 tend to have more heavily encrusted aluminosilicate spheres as well as agglomerations of smaller spheres (FIGS. 15A-15C). (Wirth, X.; Benkeser, D.; Yeboah, N. N. N.; Shearer, C.; Kurtis, K.; Burns, S., Evaluation of Alternative Fly Ashes as Supplementary Cementitious Materials. *ACI Mater. J.* 2019, 116). This is the result of weathering and precipitation in ash ponds.

Following combustion, CFA may be mixed with water to form a slurry that can be pumped to a storage pond, where the CFA is weathered by water from above and below. CFA-F2 was such a sample. This hydration has two major effects: (1) new mineral phases develop, including carbonates, and amorphous clays (from glass hydrolysis); and (2) alkaline metals are leached. Thus, weathered CFA may contain lower quantities of potentially interfering elements and present higher REEs concentrations in more accessible mineral forms. In this study, the REE content of CFA-F2 was slightly less than that of CFA-F1.

As further depicted in TABLE 1, mineralogy also differed between Class-C and Class-F CFAs. Class-F ashes usually contain nonreactive crystalline phases of mullite, sillimanite, and quartz. While Class-C ashes usually contain approximately the same proportion of quartz, they also are composed of reactive crystalline calcium phases like free lime, anhydrite, tricalcium aluminate, and calcium sulfoaluminate. Ca minerals are often soluble in acidic solutions. Taggart et al. hypothesized that leaching from high Ca-CFAs demonstrated higher REE recovery with acid-based leaching because Ca dissolution exposed additional surface area of CFA particles, providing greater access to REEs. Hence, it is anticipated that leaching efficiency and distribution will be higher for CFA-C1 compared to the Class-F CFA-F1 and CFA-F2.

Example 8: Ionic Liquid Extraction from CFAs without Pre-Treatment

Figure 4A:
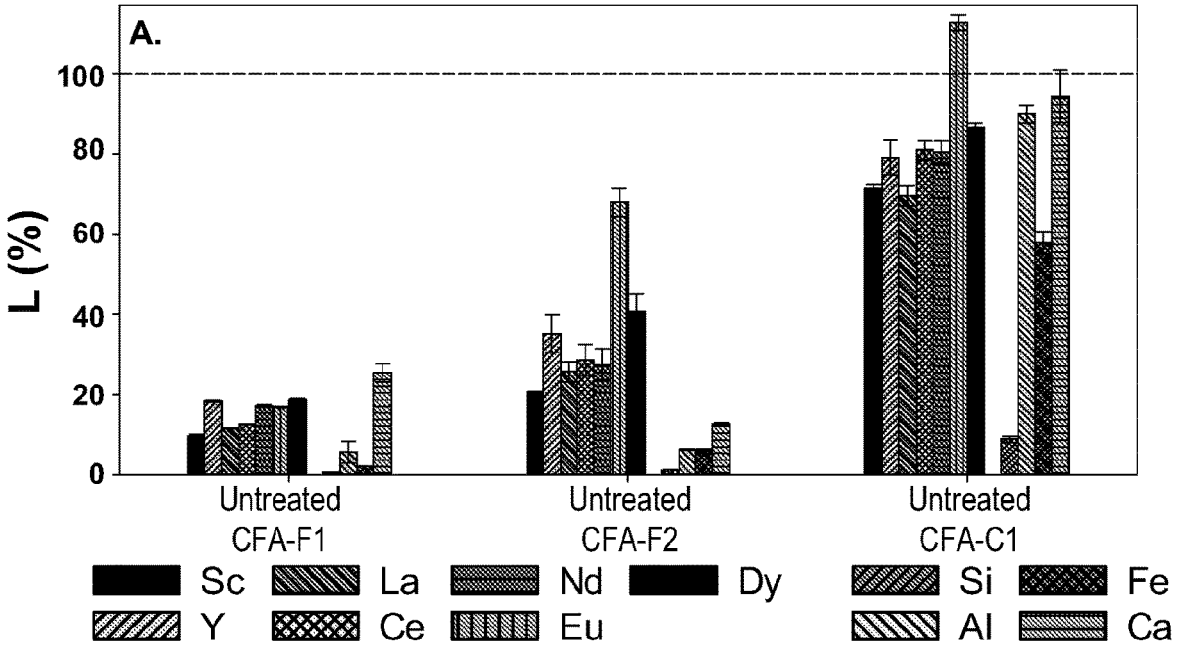
FIG. 4A shows a plot of leaching efficiency (L (%)) of components versus types of untreated metal-containing material (CFA-F1, CFA-F2, and CFA-C1) after extraction, in accordance with an exemplary embodiment of the present disclosure.
Figure 4B:
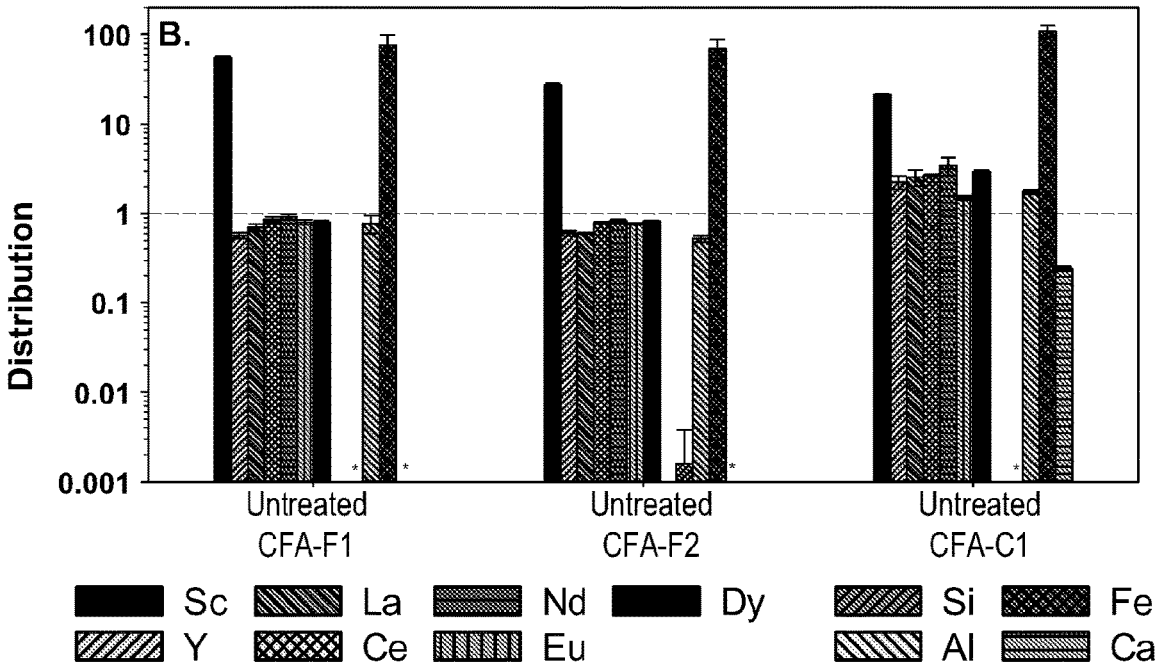
FIG. 4B shows a plot of distribution of components after extraction versus types of untreated metal-containing material (CFA-F1, CFA-F2, and CFA-C1), in accordance with an exemplary embodiment of the present disclosure.

Owing to [Hbet][$Tf_2N$]'s thermomorphic behavior, leaching and stripping can be performed by contacting the ionic liquid with aqueous solutions and applying heat. In addition to its role in partitioning, water also reduces the viscosity of the mixture, which increases mass transfer. Sodium nitrate was added to the aqueous phase to promote separation between the aqueous and ionic liquid phases. The results of ionic liquid leaching and stripping for all CFA samples are shown in FIGS. 4A and 4B.

Class-F Ashes. As FIGS. 4A and 4B show, Class-F ashes demonstrated low leaching efficiencies for all REES ($L_{REEs}$<~20% and <~40% for CFA-F1 and CFA-F2, respectively), as well as for bulk elements ($L_{Bulk}$<7%). Considering that about 71-83% of CFA composition is $Al_2O_3$ and $SiO_2$, and the leaching efficiency was only ~6% for Al and negligible for Si for both ashes, it can be concluded that the CFA particles were largely unaffected by the ionic liquid process. $L_{ca}$ was higher for CFA-F1 vs. CFA-F2.

The distribution between ionic liquid and aqueous phase, $D_{REEs}$, was similar for both CFAs, and low values were observed for most REEs ($D_{REEs}$≤0.21 for CFA-F1, $D_{REEs}$≤0.44 for CFA-F2) with the exception of scandium ($D_{Sc}$=4.6 for CFA-F1, 3.8 for CFA-F2). Interestingly, while Sc displayed the highest D, it had the lowest leaching efficiency of all REEs. Bulk elements largely demonstrated low distributions ($D_{Al,\ Ca,\ Si}$<0.10 for CFA-F1; $D_{Al,\ Ca,\ Si}$<0.65 for CFA-F2) with the exception of Fe ($D_{Fe}$=9.2 for CFA-F1, 8.8 for CFA-F2).

Only Sc and Fe both showed a strong preference for the ionic liquid phase (D>1). This behavior is consistent with previous literature on [Hbet][$Tf_2N$]. Under acidic conditions, carboxylic acid-based extractants tend to form strong complexes with ions with high charge density and high electronegativity. Trivalent REEs have high charge density, but $Fe^{3+}$ and $Sc^{3+}$ display higher charge density as a result of their smaller ionic radii. Thus, Fe- and Sc-betaine complexes tend to be more stable than other REE-betaine complexes, leading to more efficient extraction into the ionic liquid phase. As for the other bulk elements, Si showed no potential to partition into the ionic liquid phase likely because silica is poorly soluble due to its formation of oxyanions, which are sterically hindered from complexing with betaine. The partitioning mechanism for Al and Ca is not as obvious, but it may be the result of a number of factors beyond steric geometry, including ionic radius, charge density, basicity, and electronegativity. It may be that free Al precipitates as an aluminosilicate or forms other complexes with anions leached from the CFA, which include $F^-$, $Cl^-$, $CO_3^{2-}$, $NO_3^-$, and $SO_4^{2-}$, as well as oxyanions of heavy metals.

It is expected that weathered ashes like CFA-F2 lack major cations and contain more amorphous content compared to unweathered ash as a result of exposure to standing water. Theoretically this would result in considerably higher $D_{REEs}$ and $L_{REEs}$ in weathered versus unweathered CFA. The weathered CFA-F2 analyzed in this study did not contain a higher proportion of amorphous phases compared to CFA-F1 according to the XRD analysis (TABLE 1), and L was only slightly higher for REEs and negligibly different for bulk elements. These results support literature indicating that weathering induces morphological changes in the CFA that, rather than resulting in more accessible REEs, entraps them in secondary (or tertiary) mineral formation (Wirth, X.; Glatstein, D. A.; Burns, S. E., Mineral phases and carbon content in weathered fly ashes. *Fuel* 2019, 236, 1567-1576). It also may be that the CFA-F2 sample only demonstrates minor weathering damage compared to other CFAs.

Class-C Ash. As FIGS. 4A and 4B show, the Class-C CFA-C1 demonstrated high leaching efficiency for all REEs ($L_{REE,avg}$=~83%), with Sc displaying slightly lower leaching efficiency than other REEs (average $L_{Sc}$=71.4%). Unlike with the Class-F CFAs, leaching efficiencies were high for Al, Ca, and Fe, while $L_{Si}$ remained low for CFA-C1. Class-C ashes are widely known to be less recalcitrant than Class-F ashes. Taggart et al. noted that Powder River Basin CFAs (Ca-rich Class-C CFAs) have lower total REE concentrations but demonstrated superior recovery by nitric acid (pKa=−1.4) extraction. They hypothesized that CaO dissolved under the acidic condition, exposing additional CFA particle surface area and releasing REEs (Taggart, R. K.; Hower, J. C.; Hsu-Kim, H., Effects of roasting additives and leaching parameters on the extraction of rare earth elements from coal fly ash. *Int. J. Coal Geol.* 2018, 196, 106-114). In the present disclosure, the equilibrium pH of the ionic liquid leaching process is around 1.3 and [Hbet][$Tf_2N$] has pKa around 1.82. Furthermore, King et al. surmised that acid leaching of CFA may generate a silicon-rich gel layer over the ash, which may be destabilized by calcium. Thus, it is expected that Ca-rich Class-C CFAs leach more significantly under acidic conditions than Class-F CFAs. CFA-C1 also showed higher D for all elements compared to CFA-F1 and CFA-F2, indicating that, not only is more material leached from this CFA, but more distributes into the ionic liquid phase (FIGS. 4A and 4B). Notably, for all REEs, $D_{REEs}$>1. Scandium showed distribution ($D_{Sc}$=24.2) an order of magnitude higher than $D_{Sc}$ for CFA-F1 and CFA-F2. The high $D_{REEs}$ may be the result of greater accessibility of the REEs promoted by CaO dissolution during leaching. While $D_{Ca}$ is higher for CFA-C1 than other ashes, the value remains low ($D_{Ca}$=0.21), indicating that even for Ca-rich ashes, calcium does not partition strongly into the ionic liquid phase.

Example 9: Evaluation of Pretreatment of CFAs

The extraction results from CFA-F1 and CFA-F2 indicate that the CFA particles remained mostly intact in the ionic liquid leaching/stripping procedure. Given the low $L_{Al}$ and $L_{Si}$ values and the understanding that REEs are likely dispersed throughout the aluminosilicate glass phases, pretreatments of CFAs were evaluated to improve REE extraction. An effective pretreatment should minimize REE loss during pretreatment, increase leaching efficiency for REEs, and promote phase separation for REEs and bulk elements (high $D_{REEs}$ and low $D_{Bulk}$). Pretreatment should also minimize the production of additional wastes.

Aluminosilicate materials can be attacked by either acidic or alkaline treatments. Varying concentrations of acidic and alkaline solutions (1.0-10.0 M NaOH; 1.0-5.0 M $HNO_3$) were tested on CFA-F1 at different solid/liquid ratios (1:10, 1:25, and 1:50 (g ash)/(mL solution), with the results detailed in TABLE 2 below. The results indicated alkaline pretreatments to be more promising than acidic pretreatments, as they minimized REE loss but leached Si significantly.

Aluminosilicate materials can be attacked by either acidic or alkaline treatments. Varying concentrations of acidic and alkaline solutions (1.0 M NaOH, 5.0 M NaOH, 10.0 M NaOH, 1.0 M $HNO_3$, and 5.0 M $HNO_3$) were tested at different solid/liquid ratios (1:10, 1:25, and 1:50 in (g ash)/(mL solution)).

Overall, acidic pretreatments leached 20-70% of certain REEs while alkaline pretreatments leached undetectable levels of REEs at all tested solid/liquid ratios for CFA-F1, with the exception of Nd. More Nd leached as the solid/liquid ratio and NaOH concentration increased.

Acidic pretreatments leached relatively small amounts of Al, Ca, and Fe at all solid/liquid ratios, while Si was not detected in the leachate solution. Minor constituents (Mg, Ti, and Mn) leached consistently across all acidic treatments. Alkaline pretreatments generally leached small amounts (<10 wt. %) of all elements with the exception of Si, with Si loss increasing as alkaline content (concentration and solid/liquid ratio) increased. Under alkaline conditions, Si demonstrated significant leaching above 5.0 M NaOH, ranging from 27-67%. NaOH is widely known to be a desilication agent.

The ideal pretreatment should damage the aluminosilicate structure but not to dissolve it completely. Alkaline pretreatments were deemed to be more promising as they minimized REE loss but leached Si significantly. The alkaline pretreatments at 1:50 g/mL were eliminated due to high bulk element leaching and the desire to minimize additional waste. Thus, alkaline pretreatments of CFAs at solid/liquid ratios of 1:10 and 1:25 g/mL were adopted and followed by the ionic liquid leaching/stripping to determine the optimal strategy to increase REE extraction efficiency.

TABLE 2

| | Treatment | | | | | | | | | | | | | | |
|---|---|---|---|---|---|---|---|---|---|---|---|---|---|---|---|
| | ACIDIC | | | | | | ALKALINE | | | | | | | | |
| | 5.0M $HNO_3$ | | | 10.0M $HNO_3$ | | | 1.0M NaOH | | | 5.0M NaOH | | | 10.0M NaOH | | |
| | S/L ratio (g/mL) | | | | | | | | | | | | | | |
| | 1:10 | 1:25 | 1:50 | 1:10 | 1:25 | 1:50 | 1:10 | 1:25 | 1:50 | 1:10 | 1:25 | 1:50 | 1:10 | 1:25 | 1:50 |
| Sc | 18 | 14.1 | 8.4 | 15.7 | 12.4 | 6.9 | — | — | — | — | — | — | — | — | — |
| Y | 28.2 | 25.5 | 21 | 25.4 | 22.6 | 19.9 | — | — | — | — | — | — | — | — | — |

TABLE 2-continued

| | Treatment | | | | | | | | | | | | | | |
|---|---|---|---|---|---|---|---|---|---|---|---|---|---|---|---|
| | ACIDIC | | | | | | ALKALINE | | | | | | | | |
| | 5.0M $HNO_3$ | | | 10.0M $HNO_3$ | | | 1.0M NaOH | | | 5.0M NaOH | | | 10.0M NaOH | | |
| | S/L ratio (g/mL) | | | | | | | | | | | | | | |
| | 1:10 | 1:25 | 1:50 | 1:10 | 1:25 | 1:50 | 1:10 | 1:25 | 1:50 | 1:10 | 1:25 | 1:50 | 1:10 | 1:25 | 1:50 |
| La | 21.5 | 21.7 | 22.5 | 19.3 | 20.7 | 21.2 | — | — | — | — | — | — | — | — | — |
| Ce | 24.4 | 25.2 | 29.5 | 21.6 | 24.9 | 24.7 | — | — | — | — | — | — | — | — | — |
| Nd | 38.4 | 45.7 | 62.6 | 35.7 | 48.6 | 68.6 | — | — | 17.8 | 4.3 | 14.3 | 25.3 | 3.9 | 13 | 40.9 |
| Eu | — | — | — | — | — | — | — | — | — | — | — | — | — | — | — |
| Dy | 27.2 | — | — | 24.8 | — | — | — | — | — | — | — | — | — | — | — |
| Si | — | — | — | — | — | — | 7.1 | 11.9 | 1.2 | 50.6 | 40.4 | 66.8 | 10.6 | 38.4 | 90.8 |
| Al | 10.2 | 36 | 8.7 | 7.8 | 3.5 | 35.9 | 0.8 | 3.4 | 9.2 | 7 | 4.4 | 0.7 | 5.6 | 3.3 | 1.6 |
| Fe | 12.9 | 12.3 | 10 | 12.4 | 12.5 | 11.5 | — | 0.4 | 0.2 | 0.4 | 0.9 | 2.2 | 0.4 | 1.9 | 2.8 |
| Ca | 10.4 | 11.5 | 13.8 | 9.7 | 10.8 | 13.7 | 1.1 | 2.7 | 5.2 | 1.1 | 2.6 | 5.2 | 1 | 2.6 | 5.3 |
| Mg | 19.5 | 18.3 | 17.6 | 17.2 | 16.4 | 16.8 | 0.3 | 0.6 | 0.8 | 0.3 | 0.3 | 0.6 | 0.3 | — | — |
| Mn | 31.3 | 27.6 | 22.8 | 27.7 | 26.4 | 22.8 | — | — | — | — | — | — | — | 9.6 | 16.2 |
| Ti | 7.8 | 8 | 8.3 | 6.1 | 6.5 | 6.7 | — | — | — | 0.1 | 0.1 | 0.2 | 0.1 | 0.2 | 0.4 |

Alkaline pretreatments of CFA-F1 at solid/liquid ratios of 1:10 and 1:25 g/mL were adopted and followed by the ionic liquid leaching/stripping to determine the optimal strategy to increase REE extraction efficiency. Overall, alkaline pretreatment increased REE leaching efficiency ($L_{REEs}$) and REE distribution coefficients ($D_{REEs}$) of CFA-F1 (FIGS. 8A and 8B). Alkaline pretreatment also increased leaching efficiency of the four bulk elements (Si, Al, Fe and Ca), but appeared to have a maximum for Al (~40%) and Fe (~20%) (FIG. 8A). Only DA and Dre were impacted by alkaline pretreatment, as Si and Ca do not partition into the ionic liquid phase (FIG. 8B).

As shown in FIG. 8A, pretreatments by 1.0 M NaOH, solid/liquid ratios of 1:10 and 1:25 approximately doubled $L_{REEs}$ from that of untreated CFA. Pretreatments with 5.0 and 10.0 M NaOH increased $L_{REEs}$ to above 50%, averaging above 75%. The best pretreatment achieving acceptable $L_{REEs}$ was determined to be 5.0 M NaOH at 1:10 solid/liquid ratio for moderate alkaline liquid concentration and volume. Alkaline pretreatment also increased leaching efficiency of the four bulk elements (FIG. 8A) but appeared to have a maximum for Al (~40%) and Fe (~20%).

Interestingly, alkaline pretreatment also increased REE distribution coefficients (FIG. 8B). The highest $D_{REEs}$ were observed for pretreatments by 5.0 and 10.0 M NaOH at solid/liquid ratios 1:10 and 1:25, with no significant difference among these four pretreatments. Unfortunately, these $D_{REEs}$ values (approaching 1) indicate no strong ionic liquid phase preference, which ultimately confounds attempts to streamline separation. Of the four bulk elements, only $D_{Al}$ and $D_{Fe}$ were impacted by alkaline pretreatment, as Si and Ca do not partition into the ionic liquid phase (FIG. 8A). Under all conditions, Fe exhibited a strong preference for the ionic liquid phase ($D_{Fe}$>>1). Al only showed a response under strong conditions.

Considering the desire to limit waste production, the solid/liquid ratio of 1:10 g/mL was chosen for further testing on other CFAs.

The ideal pretreatment should damage the aluminosilicate structure but not to dissolve it completely. Alkaline pretreatments were deemed to be more promising as they minimized REE loss but leached Si significantly. The alkaline pretreatments at 1:50 g/mL were eliminated due to high bulk element leaching and the desire to minimize additional waste. Thus, alkaline pretreatments of CFAs at solid/liquid ratios of 1:10 and 1:25 g/mL were adopted and followed by the ionic liquid leaching/stripping to determine the optimal strategy to increase REE extraction efficiency.

Figure 9:
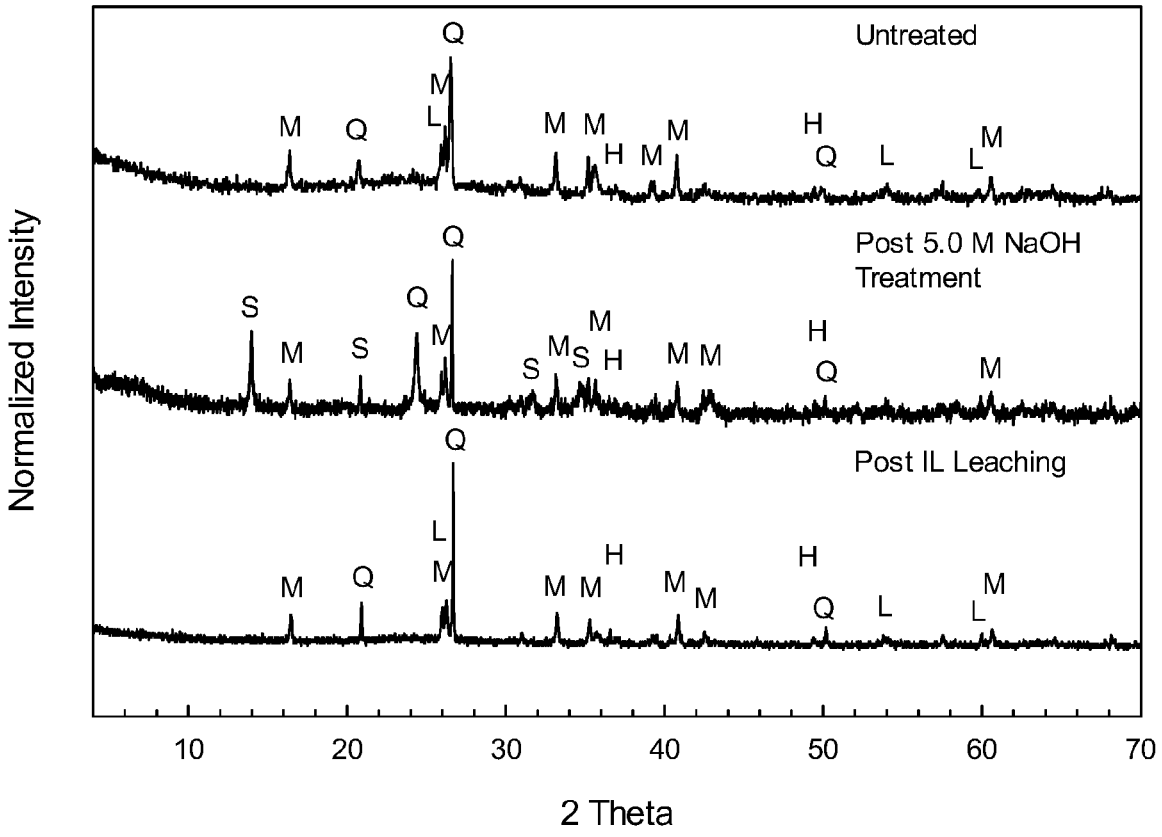
FIG. 9 shows an X-ray diffraction pattern of normalized intensity versus 2 theta (2θ) of untreated metal-containing material, pretreated metal-containing material, and component-extracted metal-containing material, in accordance with an exemplary embodiment of the present disclosure.
Figure 10:
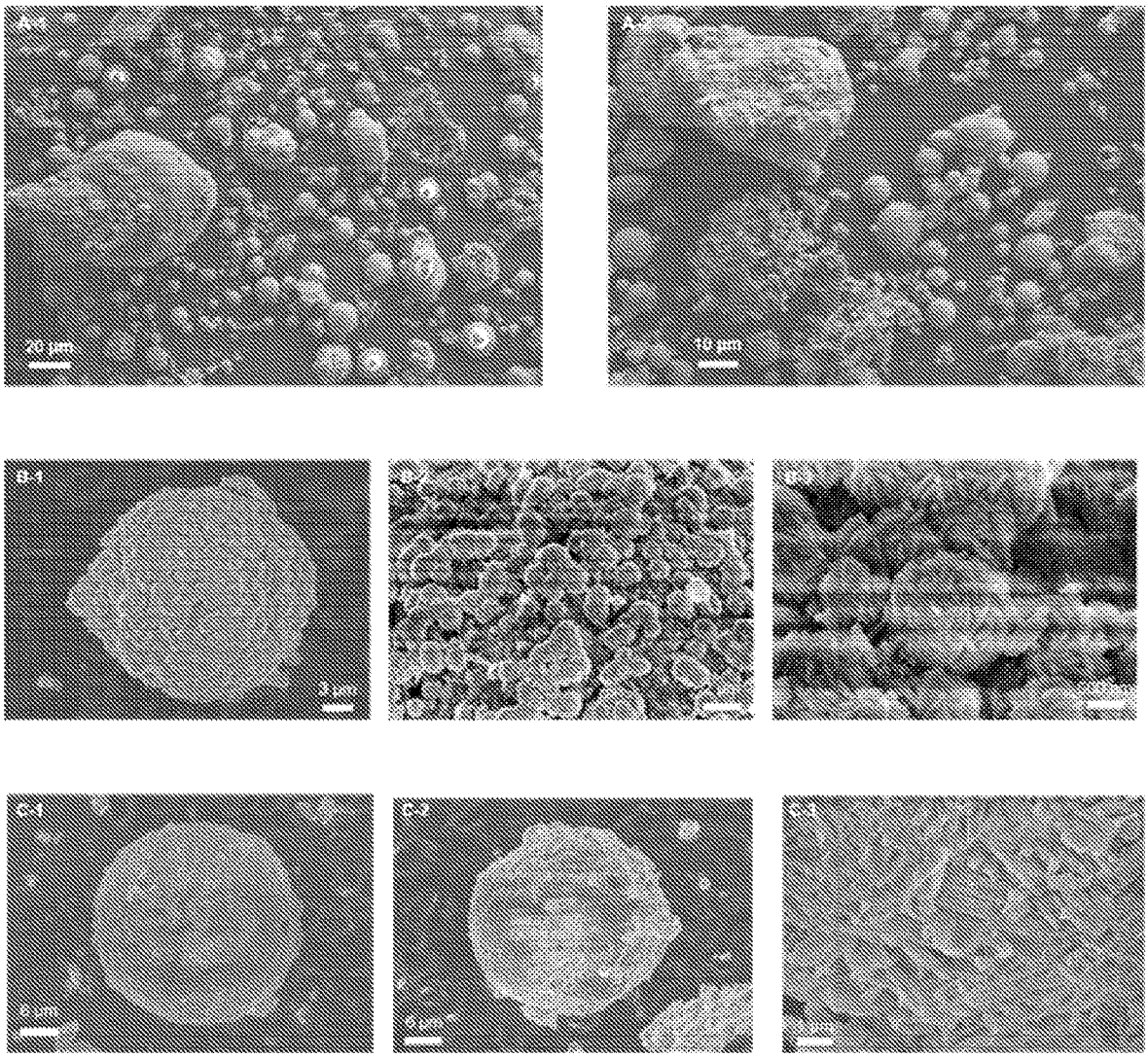
FIGS. 10A-10C illustrate SEM images for metal-containing materials.

Example 10: XRD/SEM Analysis of CFA-F1 after Pretreatments and Ionic Liquid Extraction CFA-F1 was analyzed by XRD and SEM for mineralogical and morphological changes resulting from alkaline pretreatment and ionic liquid leaching. Pretreatment of 5.0 M NaOH at a solid/liquid ratio of 1:10 g/mL resulted in loss (~10%) of amorphous content and the formation of hematite and sodium aluminum silicate hydrate, while quartz and mullite were unaffected (FIG. 9). SEM imaging (FIGS. 10A-10C) revealed two different surface morphologies: rosettes typical of hydrosodalite, and a ball of yarn shape typical of hydroxysodalite. Previous research indicates that CFA responds to alkaline treatment via desilication. NaOH dissolves glass phases: hydroxide ions break apart $SiO_4$ tetrahedral subunits via nucleophilic attack on Si—O bonds. Silica leaches into solution but reaches the maximum solubility and precipitates as amorphous silicates, including hydrosodalite and hydroxysodalite. EDS analysis confirmed the presence of $Na_2(AlSiO_3)_3$, a complex sodium silicate (often shown as $AlSiO_3(OH)_4^{3-}$) that has been described in literature as a product of sodalite dissolution under alkaline conditions. These silicates may act as a sink for leached metals during ionic liquid leaching.

The ionic liquid leaching had minimal effect on the amorphous content but resulted in the disappearance of quartz and sodium silicates (TABLE 1, and FIG. 9), which were likely dissolved by the acidic ionic liquid (pKa=2). No sodium appeared in the EDS analysis of the post ionic liquid leaching CFA, indicating dissolution into the aqueous phase during ionic liquid leaching. Increases in the weight percentage of mineral phases is likely the result of the persistence of those phases despite loss of material, which was supported by previous research.

Example 11: Ionic Liquid Extraction of CFAs with Pre-Treatment

Figure 5A:
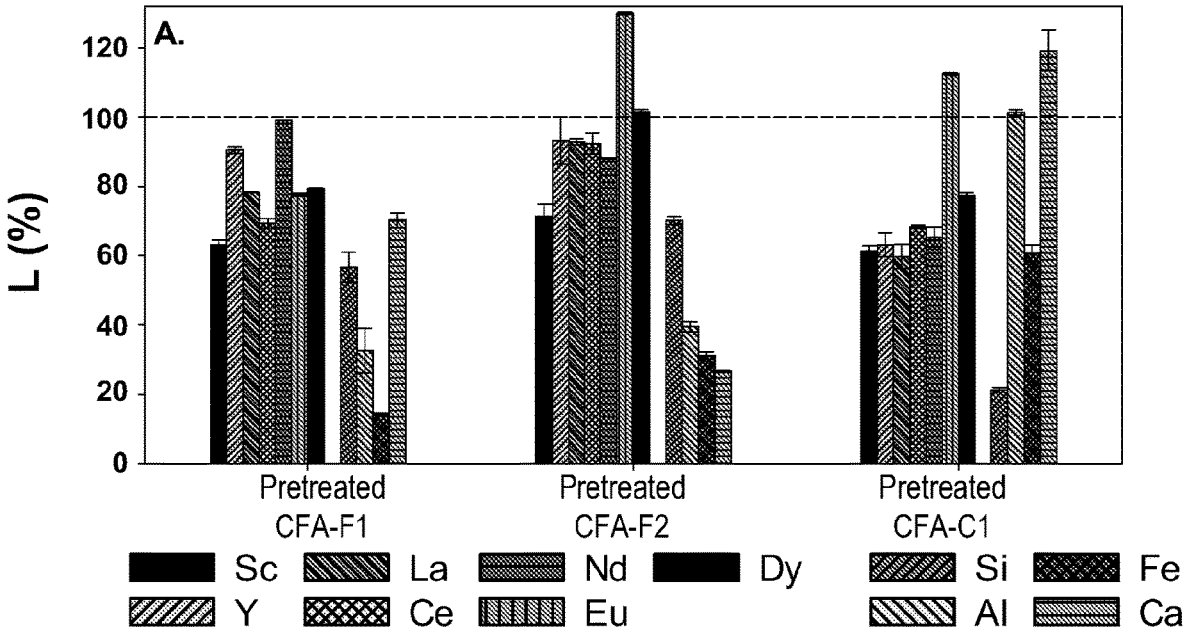
FIG. 5A shows a plot of leaching efficiency (L (%)) of components versus types of pretreated metal-containing material (CFA-F1, CFA-F2, and CFA-C1) after extraction, in accordance with an exemplary embodiment of the present disclosure.
Figure 5B:
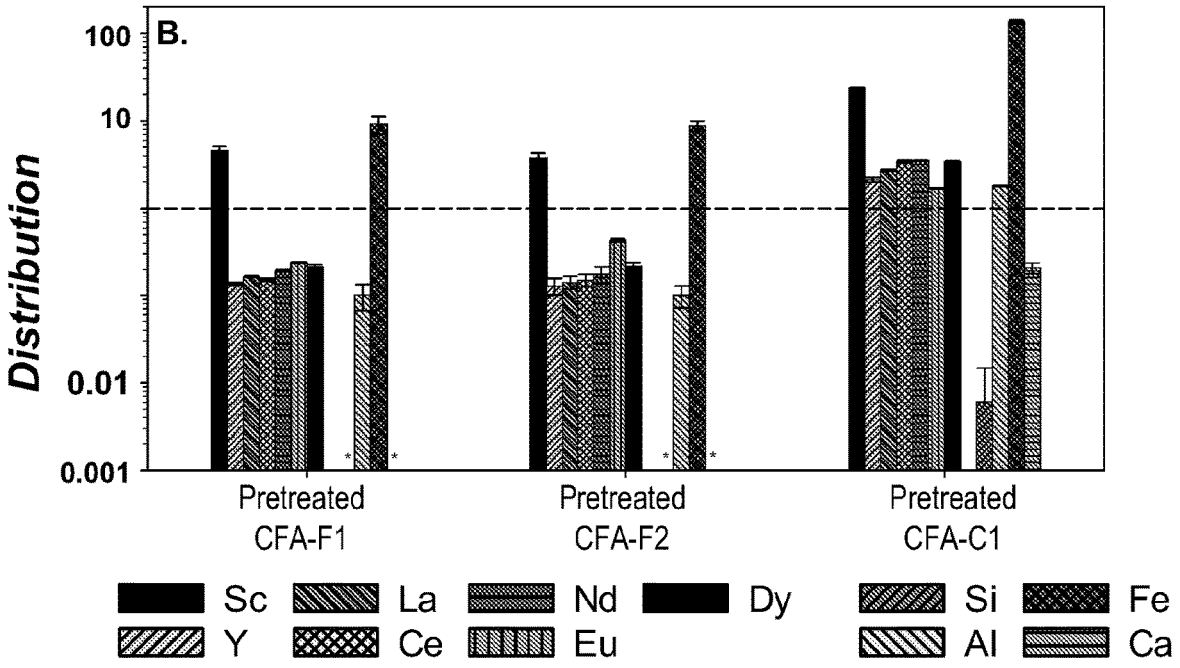
FIG. 5B shows a plot of distribution of components after extraction versus types of pretreated metal-containing material (CFA-F1, CFA-F2, and CFA-C1), in accordance with an exemplary embodiment of the present disclosure.

Following the evaluation of different pretreatments detailed above, three alkaline pretreatments (1.0 M, 5.0 M, and 10.0 M NaOH at a 1:10 g/mL solid/liquid ratio) were further evaluated to be coupled with ionic liquid leaching on three CFA samples. The solid/liquid ratio of 1:10 g/mL was chosen based on the desire to limit waste production. Pretreatment by 5.0 M NaOH was found to be the most efficient and the results are shown in FIGS. 5A and 5B. Results of the other concentration pretreatments are shown in FIGS. 11A-11C and FIGS. 12A-12C.

Interestingly, alkaline pretreatment also increased REE distribution coefficients. The highest $D_{REEs}$ were observed for pretreatments by 5.0 and 10.0 M NaOH at solid/liquid ratios 1:10 and 1:25, with no significant difference among these four pretreatments. Unfortunately, these $D_{REEs}$ values (approaching 1) indicate no strong ionic liquid phase preference, which ultimately confounds attempts to streamline separation. Of the four bulk elements, only $D_{Al}$ and $D_{Fe}$ were impacted by alkaline pretreatment, as Si and Ca do not partition into the ionic liquid phase. Under all conditions, Fe exhibited a strong preference for the ionic liquid phase ($D_{Fe}$>>1). Al only showed a response under strong conditions. Considering the desire to limit waste production, the solid/liquid ratio of 1:10 g/mL was chosen for further testing on other CFAs.

Unweathered vs. Weathered Class-F Ashes. For both CFA-F1 and CFA-F2, alkaline pretreatment resulted in <~5 wt. % loss for REEs, Al, and Fe (TABLE 2 above and TABLE 3 below). Si leaching was approximately the same for both ashes, with the highest losses reported for 5.0 M NaOH. Interesting, CFA-F2 demonstrated significantly higher losses in Ca (~23 wt. % vs. 1 wt. %) and Fe (~4 wt. % vs. 0.4 wt. %).

TABLE 3

| | ALKALINE | | |
|---|---|---|---|
| Treatment | 1.0M NaOH | 5.0M NaOH | 10.0M NaOH |
| Sc | 0.33 | 0.47 | 1.28 |
| Y | 0.12 | 0.16 | 0.16 |
| La | 0.12 | 0.05 | 0.12 |
| Ce | 0.08 | 0 | 0 |
| Nd | 0.14 | 0.08 | 0.17 |
| Eu | 4.72 | 0.98 | 3.84 |
| Dy | 0.79 | 0.83 | 0.56 |
| Si | 7.8 | 50.7 | 41.1 |
| Al | 3.2 | 1.8 | 2.8 |
| Fe | 2.5 | 4.1 | 6.7 |
| Ca | 25.4 | 22.7 | 21.6 |

Figure 11:
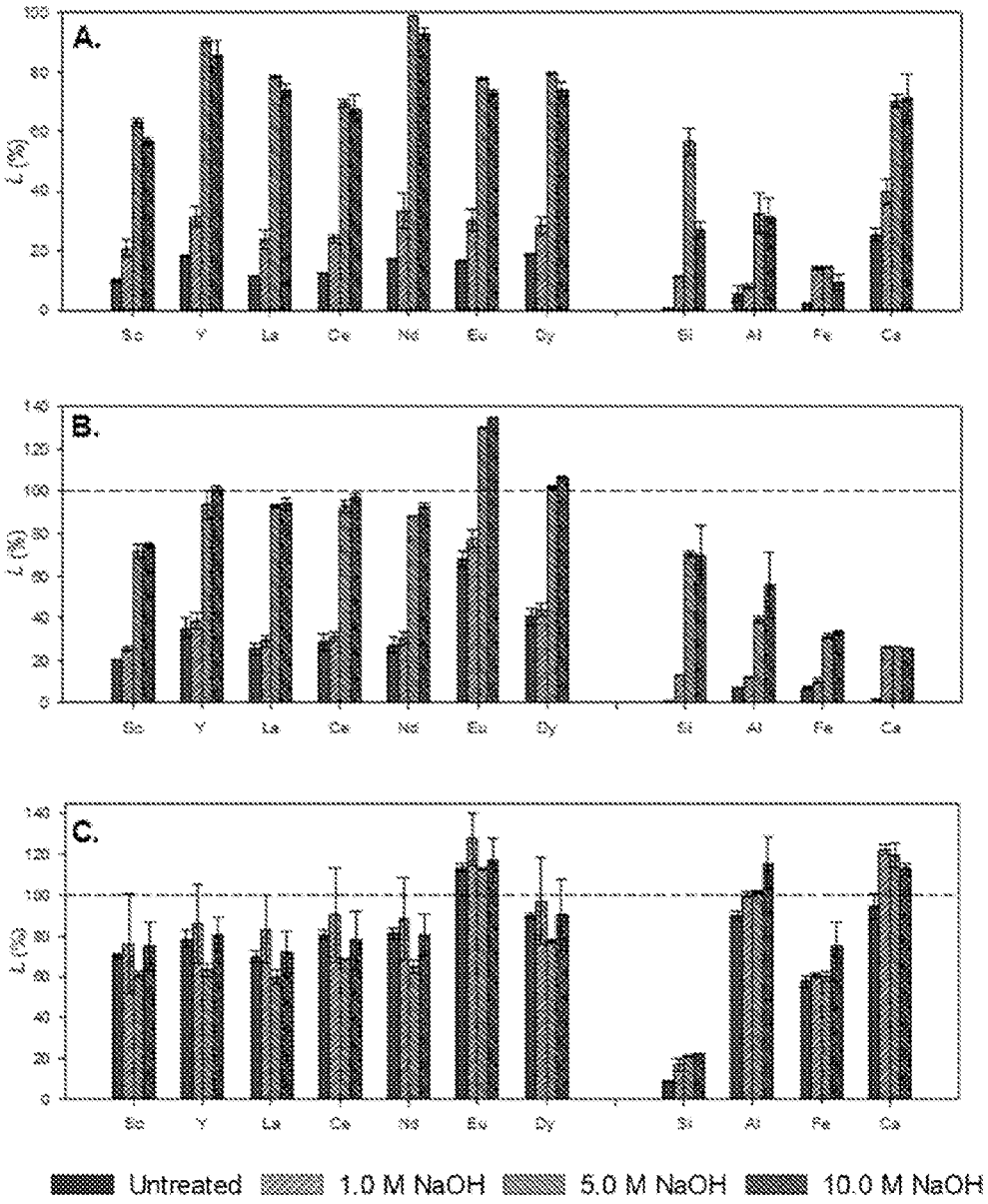
FIGS. 11A-11C show plots of leaching efficiency (L (%)) of components from pretreated and untreated metal-containing material versus type of REE and metal, in accordance with an exemplary embodiment of the present disclosure.
Figure 12:
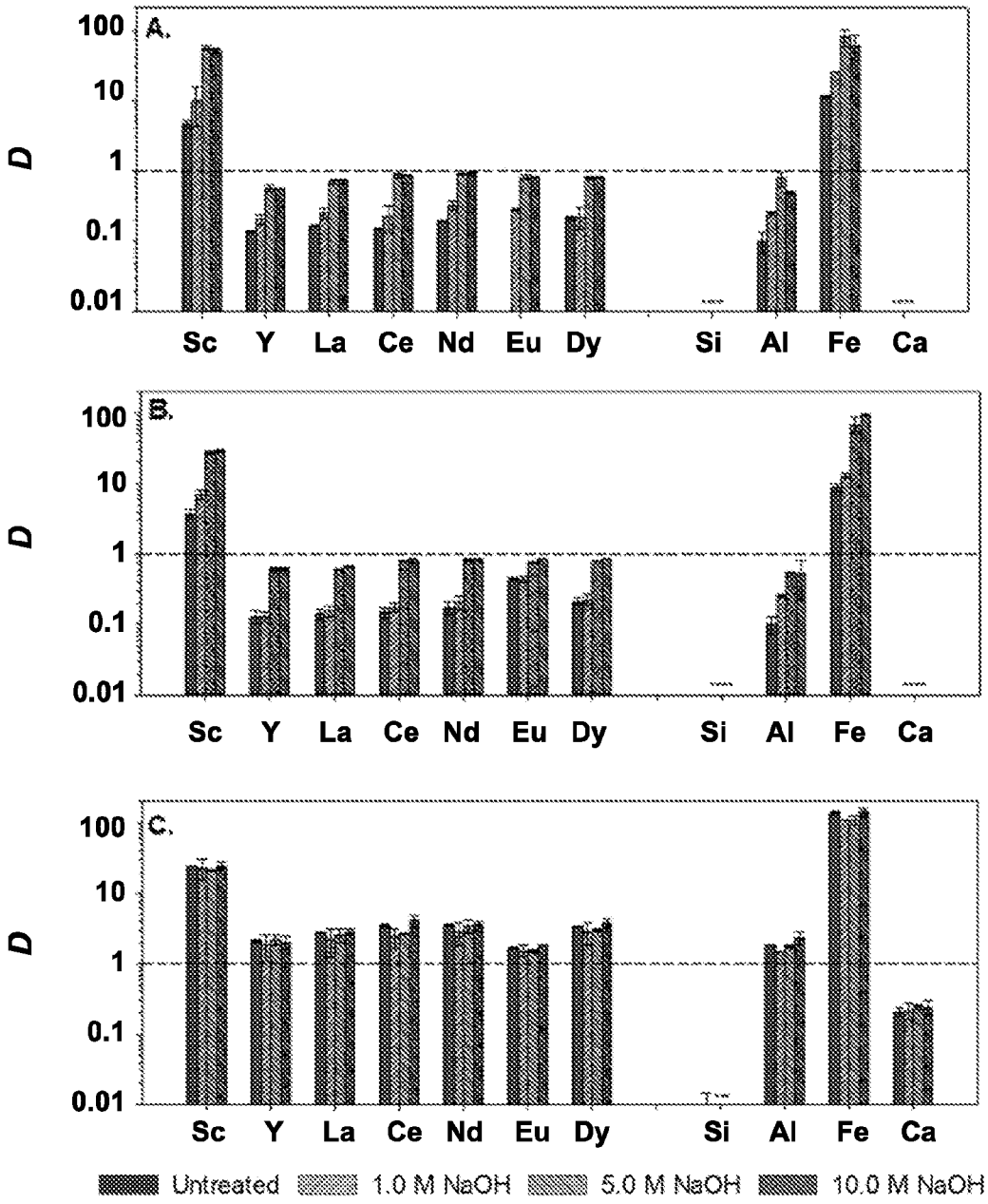
FIGS. 12A-12C show plots of distribution of components from pretreated and untreated metal-containing material versus type of REE and metal, in accordance with an exemplary embodiment of the present disclosure.

As FIGS. 11A and 11B show, alkaline pretreatment of CFA-F1 and CFA-F2 increased leaching efficiencies for all elements. Pretreatments by 5.0 and 10.0 M NaOH showed dramatic improvements, without significant difference between the two conditions. Notably, $L_{REEs}$ was higher for the weathered ash CFA-F2 than the unweathered CFA-F1 (97% and 77%, respectively). Similar to leaching efficiency, distribution D for all elements increased sharply with either 5.0 M or 10.0 M NaOH pretreatments (FIGS. 12A and 12B).

Interestingly, Ca behavior differed between CFA-F1 and CFA-F2. As noted previously, considerably more Ca was lost by CFA-F2 than by CFA-F1 in alkaline pretreatment (TABLES 2 and 3). Both CFA-F1 and CFA-F2 contained approximately the same amount of C a (~1.75 wt. %), but they might differ in the form of Ca. Ca has been reported to impact $L_{REEs}$ (see 3.2.2), and it may be the case that Ca is responsible for improved REE leaching from CFA-F2.

Alternatively, this may be the result of differences in mineralogy or of physical damage from weathering. Unweathered CFA is composed of aluminosilicate glass spheres, and in weathered CFA, these spheres are fractured. This particle damage may expose more surface area to the pretreatment and ionic liquid extraction processes.

Class-C vs. Class-F Ash. Similar to the Class-F CFAs, alkaline pretreatments resulted in negligible losses of REEs (<0.5 wt. % loss) but demonstrated higher losses for Al, Ca, and Fe (TABLE 4 below). Surprisingly, Si loss was low (<20 wt. %) even at high alkaline concentrations. $L_{REEs}$ was already high for CFA-C1 ($L_{REE,avg}$=83.0%) without pretreatment. Alkaline pretreatments did not improve $L_{REEs}$ (FIG. 11C); in fact, they either had negligible impact or slightly decreased $L_{REEs}$. L Bulk was largely unaffected, with small increases observed for Al and Ca. There was no observed impact on D for any element by the pretreatment (FIG. 12C). This may be the result of low Si leaching. For Class-C ashes, alkaline pretreatment did not improve or hinder $L_{REEs}$ and $D_{REES}$, and thus was deemed unnecessary.

TABLE 4

| | ALKALINE | | |
|---|---|---|---|
| Treatment | 1.0M NaOH | 5.0M NaOH | 10.0M NaOH |
| Sc | 0.13 | 0.13 | 0.14 |
| Y | 0.11 | 0.11 | 0.11 |
| La | 0.15 | 0.08 | 0.07 |
| Ce | 0.27 | 0 | 0 |
| Nd | 0.18 | 0 | 0 |
| Eu | 0.18 | 0.14 | 0.09 |
| Dy | 0.1 | 0.09 | 0.07 |
| Si | 1.9 | 12.9 | 18.7 |
| Al | 23.9 | 7.5 | 9.1 |
| Fe | 3.2 | 3.9 | 4.6 |
| Ca | 13 | 11.9 | 13 |

Example 12: Improving Distribution of REEs in Ionic Liquid

Alkaline pretreatment demonstrated that leaching efficiency of REEs could be successfully increased while keeping $L_{Bulk}$ low. To further improve this process, separation between REEs and bulk elements must be increased, by increasing $D_{REEs}$ and decreasing $D_{Bulk}$.

Enhancement by Betaine. Vander Hoogerstraete et al. found that adding betaine in large excess (>100×) to REEs would achieve higher distribution ratios, and that adding a stoichiometric amount of betaine was insufficient to achieve high extraction (Vander Hoogerstraete, T.; Onghena, B.; Binnemans, K., Homogeneous liquid-liquid extraction of rare earths with the betaine-betainium bis(trifluoromethylsulfonyl)imide ionic liquid system. *Int. J. Mol. Sci.* 2013, 14, (11), 21353-77; Vander Hoogerstraete, T.; Onghena, B.; Binnemans, K., Homogeneous liquid-liquid extraction of metal ions with a functionalized ionic liquid. *J. Phys. Chem. Lett.* 2013, 4, (10), 1659-63). They postulated that excess betaine shifted Eq. 1 towards the formation of $[REE(bet)_3][Tf_2N]$ complexes, which prefer the ionic liquid phase. They were able to increase $D_{Nd}$ from <1 to over 100. Hence, solid betaine chloride was dissolved into to the aqueous phase solution (1.0 M $NaNO_3$) to achieve concentrations of 1, 5, 10, 50, 100, and 200 mg betaine/g aqueous solution. The pH was modified with small amounts of NaOH and $HNO_3$ as needed. The same ionic liquid leaching/stripping protocol was followed as described above.

Figure 6A:
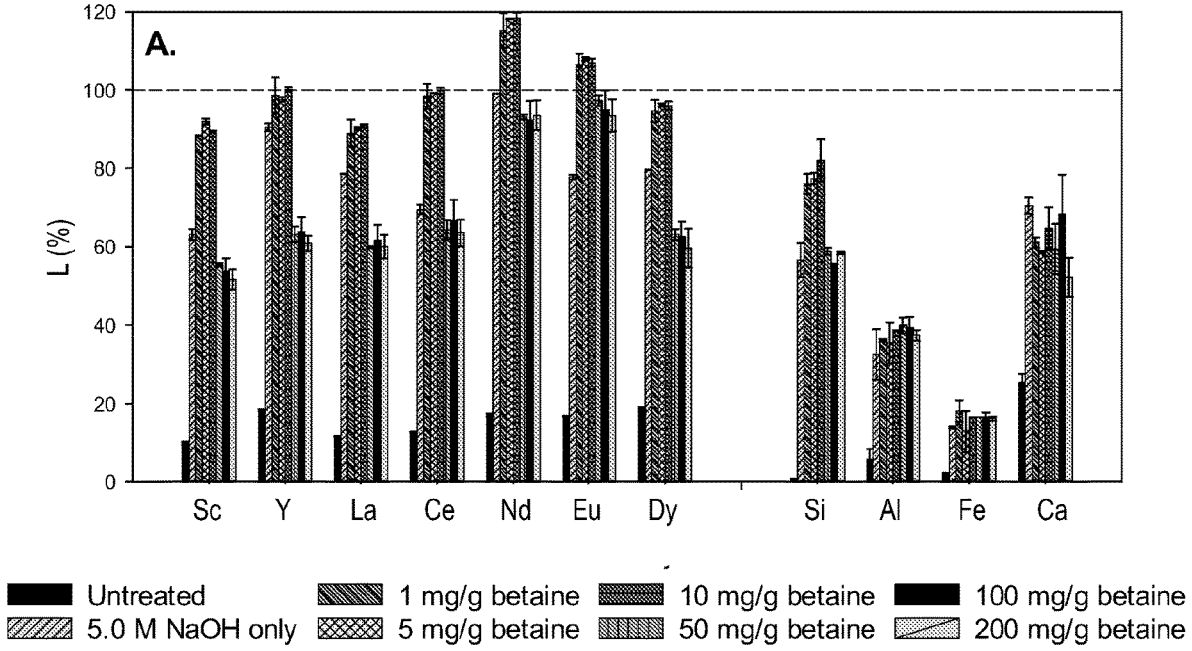
FIG. 6A shows effects of extra betaine in a plot of leaching efficiency (L (%)) of components from pretreated and untreated metal-containing material versus type of REE and metal, in accordance with an exemplary embodiment of the present disclosure.
Figure 6B:
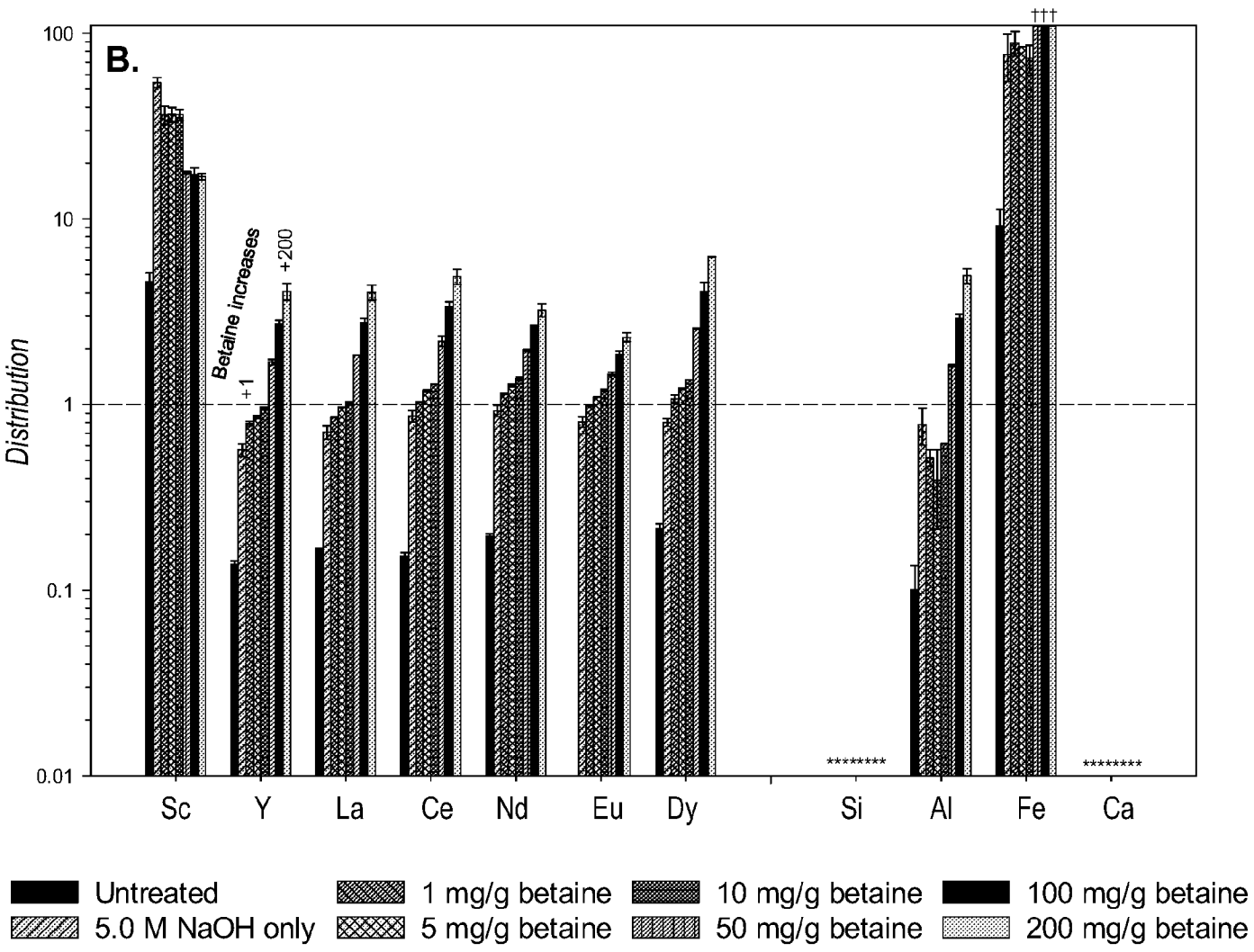
FIG. 6B shows effects of extra betaine in a plot of distribution of components from pretreated and untreated metal-containing material versus type of REE and metal, in accordance with an exemplary embodiment of the present disclosure.
Figure 6C:
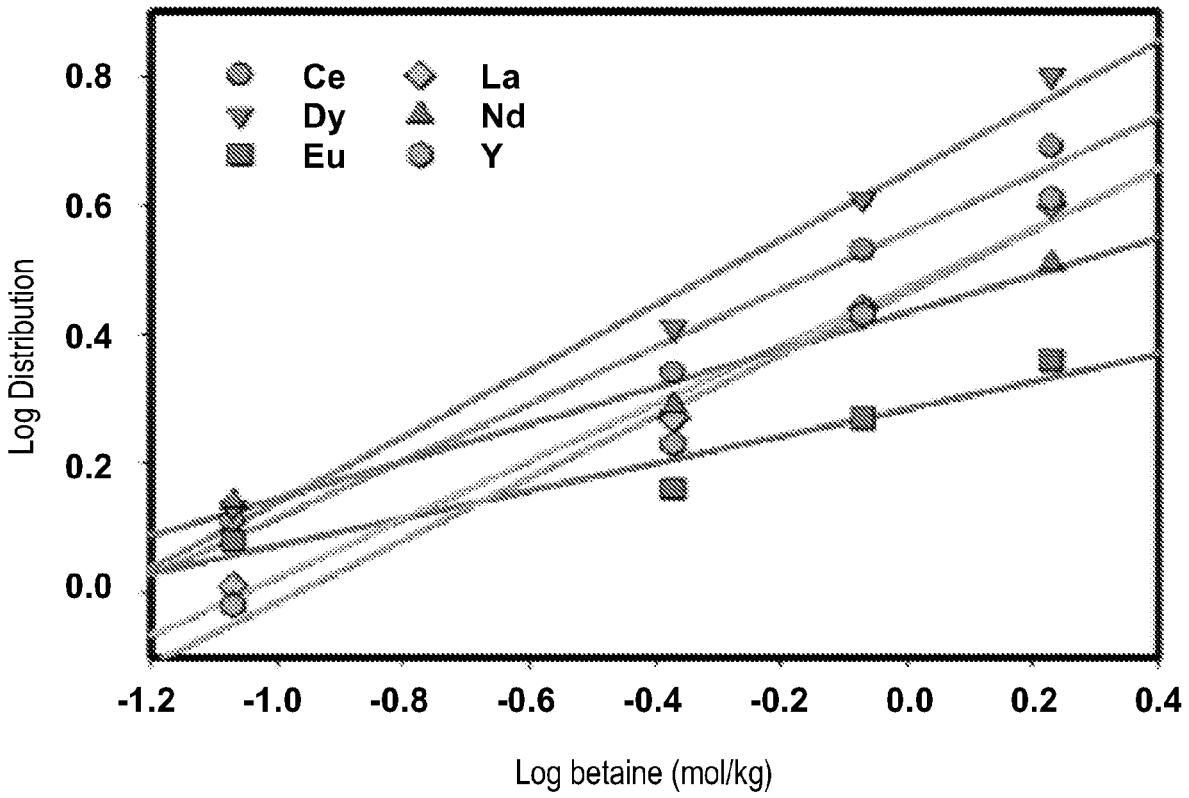
FIG. 6C shows effects of extra betaine in a plot of log distribution of components after extraction versus log betaine (mol betaine/kg aqueous solution), in accordance with an exemplary embodiment of the present disclosure.

As FIGS. 6B and 6C show, $D_{REEs}$ increased with increasing betaine for all REEs with the exception of Sc, indicating that REEs increasingly partitioned into the ionic liquid phase. Overall, $D_{REEs}$ increased to 1.0 at betaine concentration of 1 mg/g and peaked at the highest betaine concentration of 200 mg/g ($D_{Ce,\ Dy,\ La,\ Y}$>4.0). A linear relationship between log (D) and log [betaine] was observed for all the REEs except for Sc (FIGS. 6B and 6C). $D_{Sc}$ remained high but decreased some with increasing betaine concentration.

$D_{Al}$ followed a similar, nearly linear increase with increasing betaine and did not exceed 1.0 until 50 mg/g betaine was added (FIGS. 6B and 6C). Betaine addition did not influence Ca or Si partitioning ($D_{Ca}$ and $D_{Si}$ remained at near zero). $D_{Fe}$ increased at all levels of additional betaine and approached infinity above 50 mg/g betaine due to negligible amounts of Fe in the aqueous phase and high amounts of Fe in the ionic liquid phase (see Eq. 3).

Adding betaine also influenced leaching efficiency (FIG. 6A). At betaine concentrations of 1, 5, and 10 mg/g, $L_{REEs}$ was >90%. Though $L_{REEs}$ exceeded 90%, $D_{REEs}$ remained ~1 under these conditions, indicating that the majority of REEs leached out of the CFA and partitioned approximately equally into the liquid phases. At above 10 mg/g betaine concentration, however, $L_{REEs}$ fell below the levels achieved by the 5.0 M NaOH pretreatment alone (<60%).

Leaching efficiency for Al, Ca, and Fe were largely unaffected by increasing betaine (FIG. 4A). While $D_{Al}$ and $D_{Fe}$ increased with increasing betaine, $L_{Al}$ and $L_{Fe}$ were largely unchanged. $L_{Si}$ increased at intermediate levels of betaine addition.

Mechanisms. There could be several possible explanations for the decrease in $L_{REEs}$ while $D_{REEs}$ increased with increasing betaine. Si may be responsible for this phenomenon. As betaine was added, $D_{Si}$ remained near zero, indicating Si does not complex with betaine, as is consistent with previous literature. However, $L_{Si}$ followed a pattern similar to that of REEs, first increasing with small additions of betaine and then decreasing at higher betaine levels. It was observed during experimentation that the betaine chloride solutions added acidity, and experiments occurring days apart required additional alkaline input to correct pH. (Noted the pH of the aqueous phase was always checked and corrected to pH=3.50±0.05 if necessary, immediately prior to extraction experiments.) Lower than expected $L_{Si}$ values in concert with negligible $D_{Si}$ indicate that Si leached into solution only to precipitate as secondary silicates; in fact, under acidic conditions, Si forms orthosilicic acid ($SiO_4^-$), which self-polymerizes to form gels. As previously stated, King et al. found that acid leaching of CFA may generate a silicon-rich gel layer. If this gel coated CFA particle surfaces, it might have precluded access to the REEs, resulting in lower $L_{REEs}$ values but not necessarily lower $D_{REEs}$. REEs able to escape the Si-gel would strongly partition into the ionic liquid phase in the presence of additional betaine.

Another potential explanation for the decreased $L_{REEs}$ at high levels of extra betaine is that other metal cations not measured in this study may complex with betaine in competition with REEs. Interestingly, the complexation mechanism analysis discussed above and FIGS. 6B and 6C support this competition theory. Noteworthy, the ratio of betaine ligands to $REE^{3+}$ cations found in this study (0.5 or 0.25 betaine ligands per metal cation) is lower than that in previous literature (1.5 betaine ligands per metal cation) in which simple, single-cation feedstock solutions were studied (TABLE 5 below). Further research is required to elaborate on this mechanism.

TABLE 5

| Element | Slope | $R^2$ |
|---|---|---|
| Sc | −15.58 | 0.8338 |
| Y | 0.4813 | 0.9764 |
| La | 0.4509 | 0.9856 |
| Ce | 0.4437 | 0.9772 |
| Nd | 0.2872 | 0.9789 |
| Eu | 0.2131 | 0.9325 |
| Dy | 0.5045 | 0.9819 |

Upon examination, a linear relationship emerges between log distribution D and log additional betaine concentration for many of the REEs, with the exception of Sc. This relationship can be derived from the reaction below:

$$REE^{3+}_{aq} + n*(\text{bet})_{aq} + y(Tf_2N^-)_{aq} + x*H_2O \rightarrow REE(\text{bet})_n(H_2O)_x(Tf_2N)_y$$

$$\text{Define: } REE(\text{bet})_n(H_2O)_x(Tf_2N)_3 = [REE^{3+}]_{IL}$$

$$K_{eq} = \frac{[REE^{3+}]_{IL}}{[REE^{3+}]_{aq}[\text{bet}]^n_{aq}[Tf_2N^-]^y_{aq}}$$

$$\text{Recall: } D = \frac{[REE^{3+}]_{IL}}{[REE^{3+}]_{aq}}$$

$$K_{eq} = \frac{D}{|\text{bet}|^n_{aq}|Tf_2N^-|^y_{aq}}$$

$$D = K_{eq}*[\text{bet}]^u_{aq}*|Tf_2N^-|^y_{aq}$$

$$\log_{10}D = \log_{10}K_{eq} + n*\log_{10}[\text{bet}]_{aq} + y*\log_{10}[Tf_2N^-]_{aq}$$

Research done by Vander Hoogerstraete, described above, indicates that the concentration of $[Tf_2N]$ in the aqueous phase remains constant when betaine chloride is added in different amounts. Thus, the Key and $[Tf_2N]$ terms can be combined as a single constant, B, as in the following equation.

$$\log_{10} D = n^*\log_{10}[\text{bet}]_{aq}|B$$

Previous research has found different values for the slope of the log D vs log [bet], n, which represents the number of betaine ligands per metal cation of interest. Vander Hoogerstraete et al. examined this using a simple feedstock system in which $NdTf_2N$ is the only metal salt present ($[Nd^{3+}]$= 1500 ppm) and no pH adjustments were made. They determined n to be ~1.5 betaine ligands per Nd atom, indicating the formation of $[Nd_2(\text{bet})_3(H_2O)_y]^{3+}$. In the solid state, Nd and other REEs form bidentate complexes with eight betaine ligands.

As seen in TABLE 5 above, one set of elements (Y, La, Ce, Dy) has a slope value of approximately 0.5, indicating the formation of $[REE_2(\text{bet})(H_2O)_y]^{6+}$. Another set (Nd, Eu) have a slope value of approximately 0.25, indicating the formation of $[REE_4(\text{bet})(H_2O)_x]^{12+}$. Electroneutrality may be achieved using $[Tf_2N^-]$ or other anions present (nitrate, chloride, etc.).

There is no obvious trend between these elements (charge density, atomic radius, electronegativity) or explanation of the dramatic difference between this study and previous work. However, alkaline treated CFA is a much more complex material than the simple feedstock solutions studied in previous work, as CFA contains a variety of elements at trace levels that were not analyzed in this study. It may be that the differences are the result of competition between metal cations for betaine. Further research is currently underway at this lab to elaborate on the mechanism behind this observation.

Example 13: Recycling of Ionic Liquids

Figure 7A:
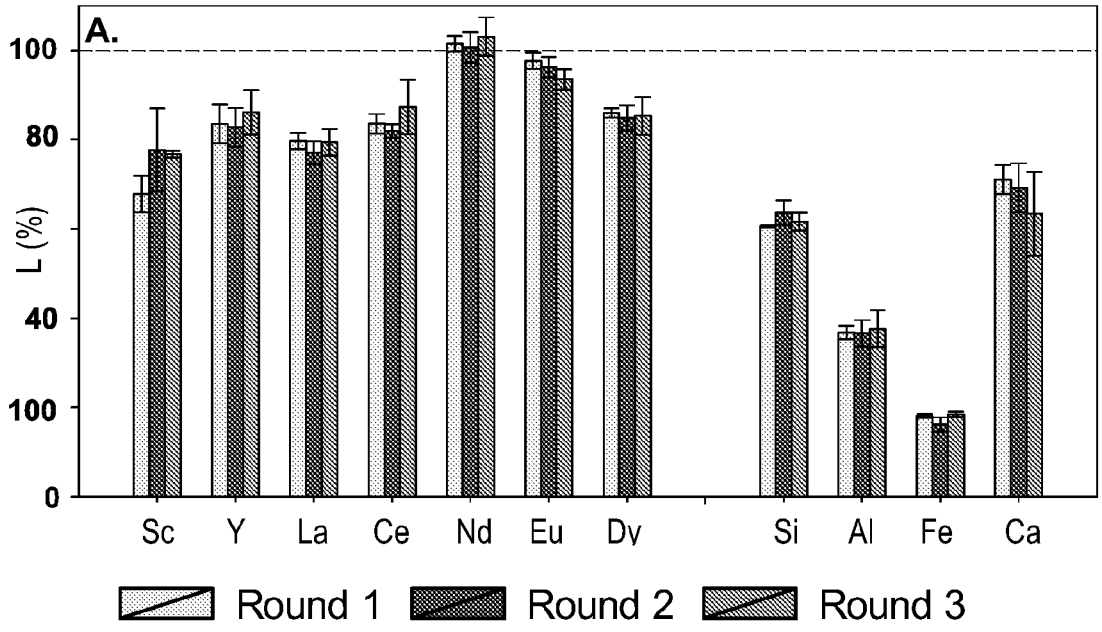
FIG. 7A shows reuse of ionic liquid in a plot of leaching efficiency (L (%)) of components after extraction from pretreated metal-containing material versus type of REE and metal, in accordance with an exemplary embodiment of the present disclosure.
Figure 7B:
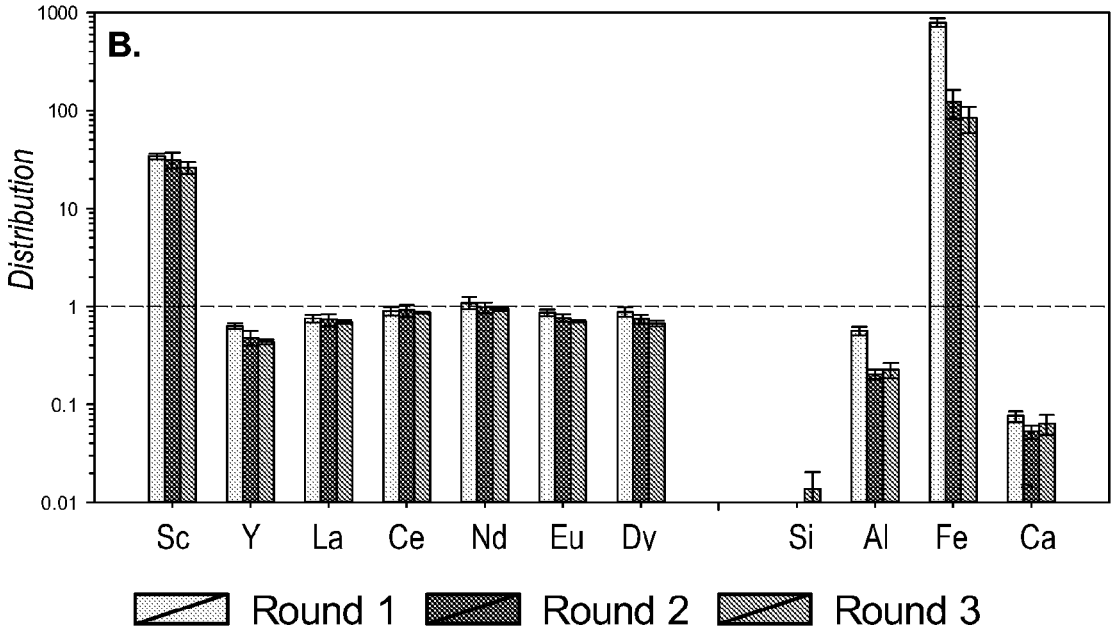
FIG. 7B shows reuse of ionic liquid a plot of distribution of components after extraction from pretreated metal-containing material versus type of REE and metal, in accordance with an exemplary embodiment of the present disclosure.

For this leaching/stripping extraction process to be viable, the ionic liquid phase should be reusable. Previous literature using both aqueous feedstocks and REE-rich solids found that the ionic liquid could be reused following stripping without any additional steps. Theoretically, stripping should be sufficient to regenerate the ionic liquid phase; however, previous research also found that extraction efficiency decreased following contact with low pH solutions. This observation was reasonable given the ionic liquid's proton exchange mechanism (Eq. 1). In this study, after extraction of the pretreated CFA-F1, the ionic liquid was contacted with cold DI water following stripping to remove excess acids. Then, the ionic liquid was reused for leaching of new CFA-F1 sample. This process was repeated twice. As FIGS. 7A and 7B shows, both $L_{REEs}$ and $D_{REEs}$ were stable over three cycles. Slight decreases were observed for $D_{Al}$ and $D_{Fe}$ in the $2^{nd}$ and $3^{rd}$ cycles. Analysis of the wash solutions showed negligible quantities of any elements. This indicates that this ionic liquid can be used successfully over multiple cycles without significant degeneration or loss in extraction efficiency or partitioning.

Example 14: Environmental Significance

CFA contains many elements present at trace levels (up to hundreds mg/kg), including arsenic, cadmium, chromium, lead, mercury, selenium, uranium, and thorium. While the concentrations of these metals are low in CFA, the toxin levels may become significant over million tons of CFA, and recent incidents of spills from CFA-holding ponds have provoked justifiable concerns about potential environmental contamination, which have prompted governmental regulation and ash pond closures. As the environmental and economic costs of storage increase, there has been a push to recycle CFA, including decades' worth of weathered CFA.

Utilizing CFA as a source of REEs presents itself as an attractive solution to not only this problem but also the REE scarcity crisis. With global demand for REEs steadily increasing, the surface mining operations have expanded, leading to pollution. In China, poorly regulated heap and in-situ leaching ponds have contaminated surface water, groundwater and soils in surrounding communities. Common contaminants include excess nitrogen and ammonium compounds, heavy metals like cadmium and lead, and radioactive materials like uranium and thorium, all posing significant health risks.

Mining operations do not only face challenges in waste generation and management, but also in chemical consumption. Thus, the ionic liquid described herein presents a major advantage due to its regenerative ability. Meanwhile, the potential risk of ionic liquids themselves should not be neglected. A recent review by Pang et al. found that toxicity of ionic liquids was largely dependent on the structure (cation family, chain length, and anion moiety) and had varying negative effects on the different model organisms studied. While there is limited toxicity data on the ionic liquid described in this paper, its cation, betaine is a nontoxic biomolecule derived from choline. A 2015 study found that a similar ionic liquid, 1-ethyl-3-methylimidazolium bis(trifluoromethylsulfonyl)imide (emim [$Tf_2N$]), is "practically harmless" based on its half maximal effective concentration ($EC_{50}$) value.

The method described in this paper offers a preferential, low-waste strategy that effectively extracts REEs from both weathered and unweathered CFAs. To the authors' best knowledge, this study represents the first work to demonstrate direct application of an ionic liquid to CFA for efficient recovery of REEs.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way.

What is claimed is:

1. A method to extract components from a metal-containing material comprising:

combining at least a portion of a metal-containing material with a first multicomponent system comprising an ionic liquid and a first aqueous component;

adjusting the temperature of the first multicomponent system to form a miscible mixture with the ionic liquid and the first aqueous component;

reverting the temperature of the first multicomponent system to form an immiscible mixture with the ionic liquid and the first aqueous component; and isolating at least a portion of the ionic liquid from the first aqueous component and the metal-containing material;

wherein the metal-containing material is pretreated with an alkaline component comprising an aqueous solution prior to combining the metal-containing material with the first multicomponent system;

wherein the isolated portion of the ionic liquid comprises one or more metals from the metal-containing material.

2. The method of claim 1 further comprising:

prior to adjusting the temperature of the first multicomponent system, adding one or more salts to the first multicomponent system to create a salt concentration of the first multicomponent system above a critical salt concentration to form a miscible mixture with the ionic liquid and the first aqueous component.

3. The method of claim 2, wherein:

the first aqueous component and the ionic liquid form an immiscible mixture when the first multicomponent system is at a temperature below a first critical temperature and/or at a pH above a critical pH value;

adjusting the temperature of the first multicomponent system comprises adjusting the temperature of the first multicomponent system above the first critical temperature and/or the pH of the first multicomponent system above the critical pH value; and reverting the temperature of the first multicomponent system comprises reverting the temperature of the first multicomponent system below the first critical temperature and/or pH of the first multicomponent system below the critical pH value.

4. The method of claim 1 further comprising:

adjusting the temperature of a second multicomponent system above a second critical temperature, the second multicomponent system comprising:

the isolated ionic liquid having one or more metals from the metal-containing material; and an acidic component;

wherein the acidic component and the isolated ionic liquid form an immiscible mixture when the second multicomponent system is at a temperature below the second critical temperature; and wherein the adjusting the temperature of the second multicomponent system above the second critical temperature forms a miscible mixture with the isolated ionic liquid and the acidic component;

reverting the temperature of the second multicomponent system below the second critical temperature to form an immiscible mixture with the isolated ionic liquid and the acidic component; and isolating the one or more metals from the second multicomponent system.

5. The method of claim 4 further comprising:

after reverting the temperature of the second multicomponent system below the second critical temperature, extracting the one or more metals from the isolated ionic liquid into the acidic component.

6. The method of claim 4 further comprising:

after isolating the one or more metals from the second multicomponent system, isolating the isolated ionic liquid from the second multicomponent system; and contacting the isolated ionic liquid with a second aqueous component.

7. The method of claim 6, wherein the second aqueous component replenishes the ionic liquid.

8. The method of claim 6 further comprising:

isolating the ionic liquid from the second aqueous component; and reusing the ionic liquid.

9. The method of claim 2, wherein the metal-containing material comprises a combustion by-product.

10. The method of claim 9, wherein the combustion by-product is selected from the group consisting of coal ash, fly ash, bottom ash, incineration ash, unrefined mineral ores, metal oxides, clays, particulate matter, soot, black carbon and combinations thereof.

11. The method of claim 2, wherein the metal-containing material has a concentration of one or more metal from about 0.001 ppm to about 100,000 ppm.

12. The method of claim 2, wherein the metal-containing material comprises one or more metals selected from the group consisting of Ba, Fe, Ti, As, Cd, Co, Cu, Hg, Mn, Ni, Pb, Rb, Sb, Sr, V, U, Ce, Dy, Er, Eu, Gd, Ho, La, Lu, Nd, Pr, Pm, Sm, Sc, Se, Tb, Th, Tm, Yb, and Y.

13. The method of claim 1, wherein the alkaline component is selected from the group consisting of NaOH, KOH, LiOH, $Ca(OH)_2$, CaO, $Mg(OH)_2$, $NH_4OH$, $NH_3$, and combinations thereof.

14. The method of claim 1, wherein the concentration of the alkaline component is from about 0.1 M to about 10 M.

15. The method of claim 1, wherein the ionic liquid comprises one or more of the following structures:

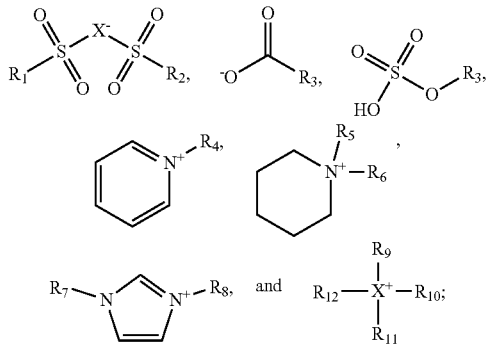

wherein:

X is N or P;

$R_1$ and $R_2$ are each independently selected from H, OH, and $CF_3$;

$R_3$ is:

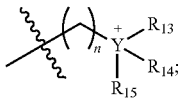

$R_4$-$R_8$ are each independently selected from H, and substituted or unsubstituted $C_{1-8}$ alkyl;

$R_9$-$R_{12}$ are each independently selected from substituted or unsubstituted $C_1$-10 alkyl and $(C_{1-10})$—OH;

Y is N or P;

n is an integer ranging from 1 to 8; and

R13, R14, and Ris are each independently selected from H, and substituted or unsubstituted C1-8alkyl.

16. The method of claim 1, wherein the ionic liquid comprises at least one cation and at least one anion.

17. The method of claim 16, wherein the cation is selected from the group consisting of a carboxylic acid, a sulfonic acid, an alkylsulfuric acid, a choline and a combination thereof.

18. The method of claim 16, wherein the anion is selected from the group consisting of a bis (trifluoromethylsulfonyl) imide, a hexafluorophosphate, a tetrafluoroborate, a nitrate, a triflate, a mesylate, a chloride, and combinations thereof.

19. The method of claim 1, wherein the ionic liquid comprises [H(bet)] $[Tf_2N]$.

20. The method of claim 1, wherein the ionic liquid comprises a room-temperature ionic liquid.

21. The method of claim 4, wherein the second critical temperature is from about 30° C. to about 70° C.

22. The method of claim 4, wherein the first critical temperature is the same as the second critical temperature.

23. The method of claim 4, wherein the first critical temperature is a different than the second critical temperature.

24. The method of claim 4, wherein the acidic component comprises an aqueous solution.

25. The method of claim 4, wherein the acidic component is selected from the group consisting of HCI, $HTf_2N$, $HNO_3$, $H_3PO_4$, $H_2SO_4$, $H_3BO_3$, HF, HBr, $HClO_4$, HI, and combinations thereof.

26. The method of claim 4, wherein the acidic component comprises a solid.

27. The method of claim 4, wherein the acidic component is selected from the group consisting of oxalic acid, citric acid, tartaric acid, maleic acid, formic acid, acetic acid, trichloroacetic acid, hydrocyanic acid, and combinations thereof.

28. The method of claim 1, wherein isolating the one or more metals from the second multicomponent system comprises one or more of filtering, decanting, centrifuging, distilling, precipitating, calcinating, evaporating, and applying an electrical potential.

29. The method of claim 6, wherein the second aqueous component comprises an aqueous solution.

30. The method of claim 8, wherein isolating the ionic liquid from the second aqueous component comprises one or more of decanting, centrifuging, distilling, and evaporating.

* * * * *